US012042716B2

(12) United States Patent
Huang

(10) Patent No.: US 12,042,716 B2
(45) Date of Patent: Jul. 23, 2024

(54) POWERED WHEELED BOARD

(71) Applicant: Razor USA LLC, Cerritos, CA (US)

(72) Inventor: Joey Chih-Wei Huang, Temple City, CA (US)

(73) Assignee: Razor USA LLC, Cerritos, CA (US)

( * ) Notice: Subject to any disclaimer, the term of this patent is extended or adjusted under 35 U.S.C. 154(b) by 0 days.

(21) Appl. No.: 15/954,934

(22) Filed: Apr. 17, 2018

(65) Prior Publication Data

US 2018/0296907 A1 Oct. 18, 2018

Related U.S. Application Data

(60) Provisional application No. 62/486,842, filed on Apr. 18, 2017.

(51) Int. Cl.

| | |
|---|---|
| ***A63C 17/00*** | (2006.01) |
| ***A63C 17/01*** | (2006.01) |
| ***A63C 17/12*** | (2006.01) |

(52) U.S. Cl.

CPC ..... *A63C 17/12* (2013.01); *A63C 17/004* (2013.01); *A63C 17/011* (2013.01); *A63C 17/014* (2013.01); *A63C 17/017* (2013.01); *A63C 2203/12* (2013.01); *A63C 2203/22* (2013.01); *A63C 2203/24* (2013.01); *A63C 2203/40* (2013.01); *A63C 2203/42* (2013.01)

(58) Field of Classification Search

CPC ..... A63C 17/12; A63C 17/01; A63C 17/011; A63C 17/014; A63C 17/017

USPC ..... 180/181

See application file for complete search history.

(56) References Cited

U.S. PATENT DOCUMENTS

| | | | |
|---|---|---|---|
| 2,051,762 | A | 8/1936 | Vincent |
| 3,288,251 | A | 11/1966 | Paul |
| 3,399,904 | A | 9/1968 | Schinke |
| 3,399,906 | A | 9/1968 | Portnoff |
| 3,771,811 | A | 11/1973 | Bueno |
| 3,982,766 | A | 9/1976 | Budge |
| D243,206 | S | 1/1977 | Sherwood |
| 4,037,852 | A | 7/1977 | Bayer et al. |

(Continued)

FOREIGN PATENT DOCUMENTS

| | | |
|---|---|---|
| AU | 2007214338 | 3/2007 |
| CA | 2596570 | 10/2007 |

(Continued)

OTHER PUBLICATIONS

"About: Skateboarding; Other Boardsports", http://skateboard.about .corn/cs/fringeboarding/gr/?once-true&;.

(Continued)

*Primary Examiner* — Hau V Phan

(74) *Attorney, Agent, or Firm* — Knobbe, Martens, Olson & Bear, LLP

(57) ABSTRACT

A powered board vehicle can include a deck having a support surface, a rear wheel assembly, and a front wheel assembly. The support surface can include a forward portion, a rearward portion, and a neck that connects the forward portion with the rearward portion. The forward portion, the rearward portion, and the neck can be integrally formed. The rear wheel assembly can include a powered rear wheel. The front wheel assembly can include at least one front wheel configured to swivel about a first axis and rotate about a second axis.

21 Claims, 10 Drawing Sheets

(56) References Cited

U.S. PATENT DOCUMENTS

D246,065 S 10/1977 Saul
4,060,253 A 11/1977 Oldendorf
4,076,265 A 2/1978 Eash
4,076,267 A 2/1978 Lipscomb
4,082,306 A 4/1978 Sheldon
4,092,033 A 5/1978 Swain
4,093,252 A 6/1978 Rue
D250,492 S 12/1978 Kish
4,140,326 A 2/1979 Huber
4,245,848 A 1/1981 Dudouyt
4,295,656 A 10/1981 Moore
4,359,231 A 11/1982 Mulcahy
4,411,442 A 10/1983 Rills
4,451,055 A 5/1984 Lee
4,458,907 A 7/1984 Meredith
4,902,256 A 2/1990 Berglund
4,915,403 A 4/1990 Wild
4,921,513 A 5/1990 Parten
4,930,794 A 6/1990 Chan
4,930,924 A 6/1990 Hunt
4,955,626 A 9/1990 Smith
5,029,702 A 7/1991 Tong
5,067,058 A 11/1991 Standley
5,098,087 A 3/1992 Matile
5,160,155 A 11/1992 Barachet
5,221,111 A 6/1993 Younger
5,267,743 A 12/1993 Smisek
D345,406 S 3/1994 Shankland
D346,418 S 4/1994 Fischbach
5,330,026 A 7/1994 Hsu et al.
5,347,681 A 9/1994 Wattron et al.
5,419,570 A 5/1995 Bollotte
5,458,351 A 10/1995 Yu
5,460,558 A 10/1995 Woodstock
5,492,345 A 2/1996 Kruczek
5,505,474 A 4/1996 Yeh
5,529,523 A 6/1996 Wilhelmi
5,540,455 A 7/1996 Chambers
5,549,331 A 8/1996 Yun
5,566,956 A 10/1996 Wang
5,601,299 A 2/1997 Yun
5,622,759 A 4/1997 Fuster
5,707,068 A 1/1998 Bradfield
5,766,051 A 6/1998 Messer
5,826,895 A 10/1998 Bradfield
5,853,182 A 12/1998 Finkle
5,855,385 A 1/1999 Hambsch
5,884,983 A 3/1999 Wu
5,893,425 A * 4/1999 Finkle ..... A63C 17/01 180/180
D410,515 S 6/1999 Alexander
5,910,035 A 6/1999 Rebotier et al.
D413,954 S 9/1999 Gerlach
5,947,495 A 9/1999 Null et al.
5,984,328 A 11/1999 Tipton
D422,661 S 4/2000 Edward et al.
D422,662 S 4/2000 Edwards et al.
6,050,357 A * 4/2000 Staelin ..... A63C 17/004 180/65.1
6,056,302 A 5/2000 Smith
6,059,303 A 5/2000 Bradfield
6,102,415 A 8/2000 Stewardson
6,106,347 A 8/2000 Harness
6,193,249 B1 2/2001 Buscaglia
6,206,389 B1 3/2001 Yagi
6,254,113 B1 7/2001 Dornan
6,293,565 B1 9/2001 Bouchard et al.
6,315,304 B1 11/2001 Kirkland et al.
6,328,328 B1 12/2001 Finiel
6,338,494 B1 1/2002 Killian
D455,186 S 4/2002 Koester
D456,047 S 4/2002 Mandic
6,398,237 B1 6/2002 Attey
6,419,248 B1 7/2002 Kay
6,419,249 B1 7/2002 Chen
6,428,022 B1 8/2002 Namiki
6,440,526 B1 8/2002 Gamble et al.
6,481,724 B1 11/2002 Whipp
6,485,044 B1 11/2002 Blake
6,494,467 B1 12/2002 Menges
6,502,850 B1 1/2003 Schaller et al.
6,572,130 B2 6/2003 Greene et al.
6,669,215 B2 12/2003 Laporte
6,698,776 B2 3/2004 Todd
6,808,196 B2 10/2004 Des Ouches
6,863,292 B1 3/2005 Paasch et al.
D503,763 S 4/2005 Morgan
D506,427 S 6/2005 Weber
6,910,698 B2 6/2005 Turner et al.
D510,046 S 9/2005 Li
6,976,687 B2 12/2005 Beleki, Jr.
6,979,006 B2 12/2005 Pierron
7,044,486 B2 5/2006 Wright
7,053,289 B2 5/2006 Iwai et al.
7,070,193 B2 7/2006 Yamaguchi
7,083,178 B2 8/2006 Potter
7,093,842 B2 8/2006 Potter
7,182,360 B2 2/2007 Paasch et al.
7,195,259 B2 3/2007 Gang
7,198,280 B2 4/2007 Hara
7,213,823 B1 5/2007 Vujtech
7,252,625 B1 8/2007 Perka
D552,201 S 10/2007 Kwak
D556,283 S 11/2007 Hamborg et al.
7,316,597 B2 1/2008 Skedeleski
D561,289 S 2/2008 Stanisewski
7,325,819 B2 2/2008 Kwak
D564,613 S 3/2008 Hamborg
7,338,056 B2 3/2008 Chen et al.
7,367,572 B2 5/2008 Jiang
D572,332 S 7/2008 Sramek et al.
D577,789 S 9/2008 Mazur
7,441,787 B1 10/2008 Jordan
7,600,768 B2 * 10/2009 Chen ..... A63C 17/0033 280/87.042
D607,521 S 1/2010 Chables et al.
D607,524 S 1/2010 Marciano
D608,851 S 1/2010 Hillman
D614,714 S 4/2010 Walworth
7,766,351 B2 8/2010 Chen et al.
7,775,534 B2 * 8/2010 Chen ..... A63C 17/0033 280/87.01
D623,701 S 9/2010 Dalgaard
D623,702 S 9/2010 Dalgaard et al.
7,867,050 B2 1/2011 Crispin
7,891,680 B2 2/2011 Chen et al.
D638,494 S 5/2011 Scolari et al.
8,047,556 B2 11/2011 Jang et al.
8,061,725 B1 11/2011 Hawkins
8,118,319 B2 2/2012 Hsieh
D655,772 S 3/2012 Bin
8,157,274 B2 4/2012 Chen
D667,382 S 9/2012 Consentino et al.
D673,233 S 12/2012 Baggett
8,360,475 B2 * 1/2013 Cristiano ..... A63C 17/004 280/11.19
8,408,565 B2 * 4/2013 An ..... A63C 17/0033 280/87.042
8,414,000 B2 4/2013 Chen
8,469,376 B2 6/2013 Kristiansen
D692,079 S 10/2013 Mackay
D692,080 S 10/2013 Hamborg et al.
8,632,084 B2 1/2014 Lovley, II et al.
D698,881 S 2/2014 Hamborg
D699,803 S 2/2014 Yamabe
D705,372 S 5/2014 Harris
8,720,916 B2 * 5/2014 Bermal ..... A63C 17/012 280/81.5
8,857,831 B1 10/2014 Rotondo
8,864,152 B1 10/2014 Danze
8,915,506 B2 12/2014 Piaceski et al.
8,936,263 B2 1/2015 Rawlins
D724,166 S 3/2015 Hamborg et al.
D728,048 S 4/2015 Stover

(56) References Cited

U.S. PATENT DOCUMENTS

| | | | | |
|---|---|---|---|---|
| 9,010,778 | B1 | 4/2015 | Burns | |
| D739,906 | S | 9/2015 | Chen | |
| D743,381 | S | 11/2015 | Pi et al. | |
| 9,186,570 | B1 | 11/2015 | Wells | |
| 9,302,173 | B2 * | 4/2016 | DiCarlo | B62M 6/45 |
| 9,393,481 | B2 | 7/2016 | Fournier | |
| D770,585 | S | 11/2016 | Desberg | |
| 9,492,731 | B2 * | 11/2016 | Marusiak | A63C 17/012 |
| D785,115 | S | 4/2017 | Ying | |
| D789,366 | S | 6/2017 | Jentz | |
| D790,015 | S | 6/2017 | Tan | |
| 9,682,309 | B2 | 6/2017 | Huang | |
| D792,931 | S | 7/2017 | Desberg | |
| D799,450 | S | 10/2017 | Lee et al. | |
| 9,795,864 | B1 | 10/2017 | Bao | |
| 9,975,035 | B1 | 5/2018 | Wang | |
| 10,022,615 | B2 | 7/2018 | Huang | |
| 10,022,616 | B1 | 7/2018 | Consol | |
| D827,748 | S | 9/2018 | Desberg | |
| D829,838 | S | 10/2018 | Huang | |
| D865,096 | S | 10/2019 | Desberg | |
| 10,486,052 | B2 | 11/2019 | Choi | |
| D871,532 | S | 12/2019 | Huang | |
| 10,625,830 | B2 | 4/2020 | Lenchner et al. | |
| 10,709,960 | B2 | 7/2020 | Huang | |
| 10,787,218 | B2 | 9/2020 | Wen | |
| D899,543 | S | 10/2020 | Desberg | |
| D911,476 | S | 2/2021 | Huang | |
| D920,197 | S | 5/2021 | Wan | |
| D940,805 | S | 1/2022 | Desberg | |
| D942,572 | S | 2/2022 | Huang | |
| 11,446,562 | B2 | 9/2022 | Desberg | |
| 11,478,693 | B2 | 10/2022 | Huang | |
| 2002/0043774 | A1 | 4/2002 | Chou | |
| 2002/0067015 | A1 | 6/2002 | Tierney et al. | |
| 2002/0149166 | A1 | 10/2002 | Potter | |
| 2002/0195788 | A1 | 12/2002 | Tierney et al. | |
| 2003/0124923 | A1 | 7/2003 | Mercer | |
| 2003/0141688 | A1 | 7/2003 | Lynn | |
| 2003/0155725 | A1 | 8/2003 | Roderick | |
| 2003/0155733 | A1 | 8/2003 | Tan et al. | |
| 2004/0021281 | A1 | 2/2004 | Stephens | |
| 2004/0144582 | A1 | 7/2004 | Baker et al. | |
| 2004/0163867 | A1 * | 8/2004 | Hillman | A63C 17/12 180/180 |
| 2004/0212160 | A1 | 10/2004 | Roderick | |
| 2004/0262872 | A1 | 12/2004 | Kang | |
| 2005/0160902 | A1 | 7/2005 | Iwai et al. | |
| 2006/0032682 | A1 * | 2/2006 | Hillman | A63C 17/01 180/65.1 |
| 2006/0032685 | A1 * | 2/2006 | Koide | B65G 1/0485 180/168 |
| 2006/0038361 | A1 | 2/2006 | Sano | |
| 2006/0049595 | A1 | 3/2006 | Crigler | |
| 2006/0055135 | A1 | 3/2006 | Tracewell et al. | |
| 2006/0055137 | A1 | 3/2006 | Jiang | |
| 2006/0163830 | A1 | 7/2006 | Kwak | |
| 2007/0001414 | A1 | 1/2007 | Kang | |
| 2007/0035102 | A1 | 2/2007 | McClain | |
| 2007/0132199 | A1 | 6/2007 | Smith | |
| 2007/0252355 | A1 | 11/2007 | Chen et al. | |
| 2007/0257459 | A1 | 11/2007 | Gang | |
| 2007/0272465 | A1 | 11/2007 | Su | |
| 2007/0273118 | A1 | 11/2007 | Conrad | |
| 2007/0296164 | A1 | 12/2007 | Roderick | |
| 2009/0045598 | A1 | 2/2009 | Lee | |
| 2009/0058028 | A1 | 3/2009 | Chen | |
| 2009/0134591 | A1 | 5/2009 | Chen et al. | |
| 2009/0206571 | A1 | 8/2009 | Francom et al. | |
| 2009/0270002 | A1 | 10/2009 | Crispin | |
| 2009/0295111 | A1 | 12/2009 | O'Rourke | |
| 2010/0222941 | A1 | 9/2010 | Chang | |
| 2010/0225080 | A1 * | 9/2010 | Smith | A63C 17/0033 280/87.042 |
| 2010/0253027 | A1 | 10/2010 | Chen et al. | |
| 2011/0006497 | A1 | 1/2011 | Chen et al. | |
| 2011/0037238 | A1 | 2/2011 | Devine | |
| 2011/0127740 | A1 | 6/2011 | Yamabe | |
| 2011/0133420 | A1 | 6/2011 | Smith | |
| 2011/0187069 | A1 | 8/2011 | Marcel | |
| 2012/0091677 | A1 | 4/2012 | Wu | |
| 2012/0125807 | A1 | 5/2012 | Jones et al. | |
| 2012/0187648 | A1 | 7/2012 | Chen | |
| 2013/0001910 | A1 | 1/2013 | Hsu | |
| 2013/0168936 | A1 | 7/2013 | Morita | |
| 2013/0277939 | A1 | 10/2013 | Yamabe | |
| 2014/0210175 | A1 | 7/2014 | Hsu | |
| 2015/0160902 | A1 | 6/2015 | Tsujita | |
| 2015/0202526 | A1 | 7/2015 | Rawlins | |
| 2016/0332062 | A1 | 11/2016 | Wu et al. | |
| 2017/0056756 | A1 | 3/2017 | Pikulski | |
| 2017/0151489 | A1 | 6/2017 | Kim | |
| 2018/0015354 | A1 | 1/2018 | Huang | |
| 2018/0273129 | A1 | 9/2018 | Baron | |
| 2018/0318698 | A1 | 11/2018 | Ji | |
| 2018/0361226 | A1 | 12/2018 | Cho | |
| 2019/0070486 | A1 | 3/2019 | Shi | |
| 2019/0176019 | A1 | 6/2019 | Huang | |
| 2020/0282296 | A1 | 9/2020 | Chen et al. | |
| 2020/0346099 | A1 | 11/2020 | Li | |
| 2021/0077892 | A1 | 3/2021 | Desberg | |
| 2021/0077894 | A1 | 3/2021 | Huang | |
| 2022/0096913 | A1 | 3/2022 | Chen et al. | |

FOREIGN PATENT DOCUMENTS

| | | | |
|---|---|---|---|
| CN | 101309730 | | 11/2008 |
| CN | 201205442 | | 3/2009 |
| CN | 201482126 | U | 5/2010 |
| CN | 201505425 | U | 6/2010 |
| CN | 202070117 | U | 12/2011 |
| CN | 206183946 | | 5/2017 |
| CN | 207157383 | U | 3/2018 |
| CN | 304695609 | S | 6/2018 |
| CN | 207667107 | U | 7/2018 |
| CN | 214209406 | U | 9/2021 |
| DE | 202008012754 | | 1/2009 |
| DK | 176806 | | 10/2009 |
| EP | 1511541 | | 3/2005 |
| EP | 1679101 | | 7/2006 |
| GB | 2318519 | | 4/1998 |
| GB | 2464676 | | 4/2010 |
| JP | H01-117385 | U | 8/1989 |
| JP | 10-211313 | | 8/1998 |
| JP | 2000-500369 | | 1/2000 |
| JP | 2001-029663 | | 2/2001 |
| JP | A 2002-502743 | | 1/2002 |
| JP | 2005-204961 | | 8/2005 |
| JP | 2005-537820 | | 12/2005 |
| JP | A 2008-545480 | | 12/2008 |
| JP | A 2015-527908 | | 9/2015 |
| JP | 2017-536222 | A | 12/2017 |
| KR | 1020050060368 | | 6/2005 |
| KR | 200 400 315 | Y1 | 11/2005 |
| KR | 200410530 | | 3/2006 |
| KR | 20070047491 | | 5/2007 |
| KR | 10-2007-0098467 | | 10/2007 |
| KR | 20090003996 | U | 4/2009 |
| KR | 10-0921839 | | 10/2009 |
| KR | 10-2001011023 | | 12/2011 |
| KR | 20120000804 | U | 2/2012 |
| KR | 200462622 | Y1 | 9/2012 |
| KR | 200465548 | Y1 | 2/2013 |
| KR | 20160002496 | A | 1/2016 |
| SU | 1405865 | | 4/1986 |
| TW | 247446 | | 5/1995 |
| TW | 266104 | | 12/1995 |
| TW | M427179 | U | 4/2012 |
| TW | M481045 | U | 7/2014 |
| TW | M560326 | U | 5/2018 |
| WO | WO 1993/01870 | A1 | 2/1993 |
| WO | WO 1997/018865 | | 5/1997 |
| WO | WO 1999/39787 | | 8/1999 |
| WO | WO 2002/040116 | | 5/2002 |

(56) References Cited

FOREIGN PATENT DOCUMENTS

| | | |
|---|---|---|
| WO | WO 2003/092831 | 11/2003 |
| WO | WO 2004/105901 | 12/2004 |
| WO | WO 2004/105901 A1 | 12/2004 |
| WO | WO 2006/022472 | 3/2006 |
| WO | WO 2007/102645 | 9/2007 |
| WO | WO 2007/111466 | 10/2007 |
| WO | WO 2007/117092 | 10/2007 |
| WO | WO 2007/127554 | 11/2007 |
| WO | WO 2007/139356 | 12/2007 |
| WO | WO 2009/036074 | 3/2009 |
| WO | WO 2009/100722 | 8/2009 |
| WO | WO 2009/128586 | 10/2009 |
| WO | WO 2010/019627 | 2/2010 |
| WO | WO 2012/083950 | 6/2012 |
| WO | WO 2013/012129 A1 | 1/2013 |
| WO | WO 2014/009760 | 1/2014 |
| WO | WO 2016/086066 | 6/2016 |
| WO | WO 2016/094806 A1 | 6/2016 |
| WO | WO 2018/195103 | 10/2018 |
| WO | WO 2020/181093 | 9/2020 |
| WO | WO 2021/055852 | 3/2021 |
| WO | WO 2022/072367 A1 | 4/2022 |

OTHER PUBLICATIONS

About: Skateboarding; The Wave http://skateboard.about.com/cs/fringeboarding/gr/XBoard.html.

Micelle' Electric Wave Board [XinCheJian], UL—http://xinchejian.com/2011/05/07/miclles-electric-wave-board/.

The Wave, Streetsurfing, http://www.street surfing .com/wave/ skating .html.

PCT Search Report and Written Opinion for International Application No. PCT/US2018/028007, dated Jul. 6, 2018, in 12 pages.

International Preliminary Report on Patentability and Written Opinion in International Application No. PCT/US2018/028007, mailed Oct. 31, 2019 in 7 pages.

* cited by examiner 166
134
136
155
153
167

166a
166
166b
166c
167
100
180
182
184

163
164
188

132
164
100

POWERED WHEELED BOARD

CROSS REFEERENCE

This application claims the priority benefit under 35 U.S.C. § 119 of U.S. Patent Application No. 62/486,842, filed Apr. 18, 2017, the entirety of which is hereby incorporated by reference. Additionally, any applications for which a foreign or domestic priority claim is identified in the Application Data Sheet as filed with the present application are hereby incorporated by reference in their entirety.

BACKGROUND

Field

The present disclosure relates to personal mobility vehicles, such as powered boards. In particular, the present disclosure relates to personal mobility vehicles with a rear powered wheel and/or other features.

Description of Certain Related Art

Many types of personal mobility vehicles exist, such as skateboards, scooters, bicycles, karts, etc. A user can ride such a vehicle to travel from place to place.

SUMMARY OF CERTAIN FEATURES

With the increased popularity and use of skateboards, scooters, and other motorized vehicles, the weight of an electric motor may limit the portability of the vehicle, particularly for commuters. Additionally, use of large electric motors can require large batteries, further increasing the weight of the vehicle. Thus there is a need to provide an electric vehicle having a small motor and battery to allow for a lightweight and portable electric vehicle at a low cost. A need may also still exist for new and/or improved designs, which may provide a new riding experience or unique functionality. The systems, methods and devices described herein have innovative aspects, no single one of which is indispensable or solely responsible for their desirable attributes.

According to some embodiments, a powered board vehicle includes a deck, a rear housing portion, a rear wheel assembly, and at least one front wheel. The deck can be configured to support a user. The deck can have a support surface including: a forward portion; a rearward portion; and a neck portion. The neck portion can be configured to connect the forward portion with the rearward portion. The forward portion, the rearward portion, and the neck portion can be integrally formed. The rear housing portion can be coupled with the rearward portion. The rear wheel assembly can be supported by the rear housing portion. The rear wheel assembly can include at least one rear wheel and at least one front wheel connected with the forward portion and configured to roll over a surface. The front wheel can swivel about a first axis and rotate about a second axis.

In some embodiments, the vehicle includes an auxiliary wheel assembly including: an auxiliary wheel mount; and an auxiliary wheel. In some embodiments, the auxiliary wheel is spaced away from the rear wheel assembly and the auxiliary wheel is positioned adjacent a side of the deck. In some embodiments, the auxiliary wheel extends rearwardly from the auxiliary wheel mount beyond a rear end of the support surface of the deck. In some embodiments, the auxiliary wheel assembly includes at least two auxiliary wheels. In some embodiments, the auxiliary wheel does not contact the surface when the deck is in a neutral position. The deck can be in the neutral position when the deck is positioned approximately parallel to the surface. In some embodiments, the auxiliary wheel has a diameter that is smaller than a diameter of the rear wheel.

In some embodiments, the front wheel is approximately aligned with the rear wheel in a neutral position. In some embodiments, the deck is configured to flex about the neck portion. In some embodiments, the vehicle includes a motor configured to power the rear wheel assembly. In some embodiments, the rear wheel assembly includes a rear drive assembly configured to transmit power from the motor to the rear wheel of the rear wheel assembly. In some embodiments, the vehicle includes a wired or wireless remote control that controls the powered rear wheel. In some embodiments, the front wheel extends rearward at an angle when the front wheel is in a neutral position. In some embodiments, the auxiliary wheel has an axis of rotation and wherein the axis of rotation is positioned rearward of a front portion of the auxiliary wheel mount.

According to some embodiments, a powered board vehicle can include a deck and a rear wheel assembly. The deck can support a user. The deck can have a support surface including a forward portion; a rearward portion; and a neck portion configured to connect the forward portion with the rearward portion. The rear wheel assembly can include at least one rear wheel and a rear drive assembly.

In some embodiments, the vehicle includes a rear housing portion coupled with the rearward portion. The rear housing portion can support the rear wheel assembly. In some embodiments, the rear housing portion includes a slot through which the rear wheel assembly passes through and is supported by the rear housing portion. In some embodiments, the rear wheel assembly further comprises a rear wheel mount configured to support the rear wheel. In some embodiments, the rear wheel mount includes a first side and a second side.

In some embodiments, the first side of the rear wheel mount is U-shaped. In some embodiments, the first side of the rear wheel mount includes: a first portion that extends downwardly relative to the deck; a second portion that extends horizontally from the first portion; and a third portion spaced from the first portion by the second portion. The third portion can extend upwardly relative to the second portion. In some embodiments, the second side is removably coupled to the first side such that the second side can translate in the slot away from the first side to allow the rear wheel to be removed.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION OF CERTAIN EMBODIMENTS

Figure 1:
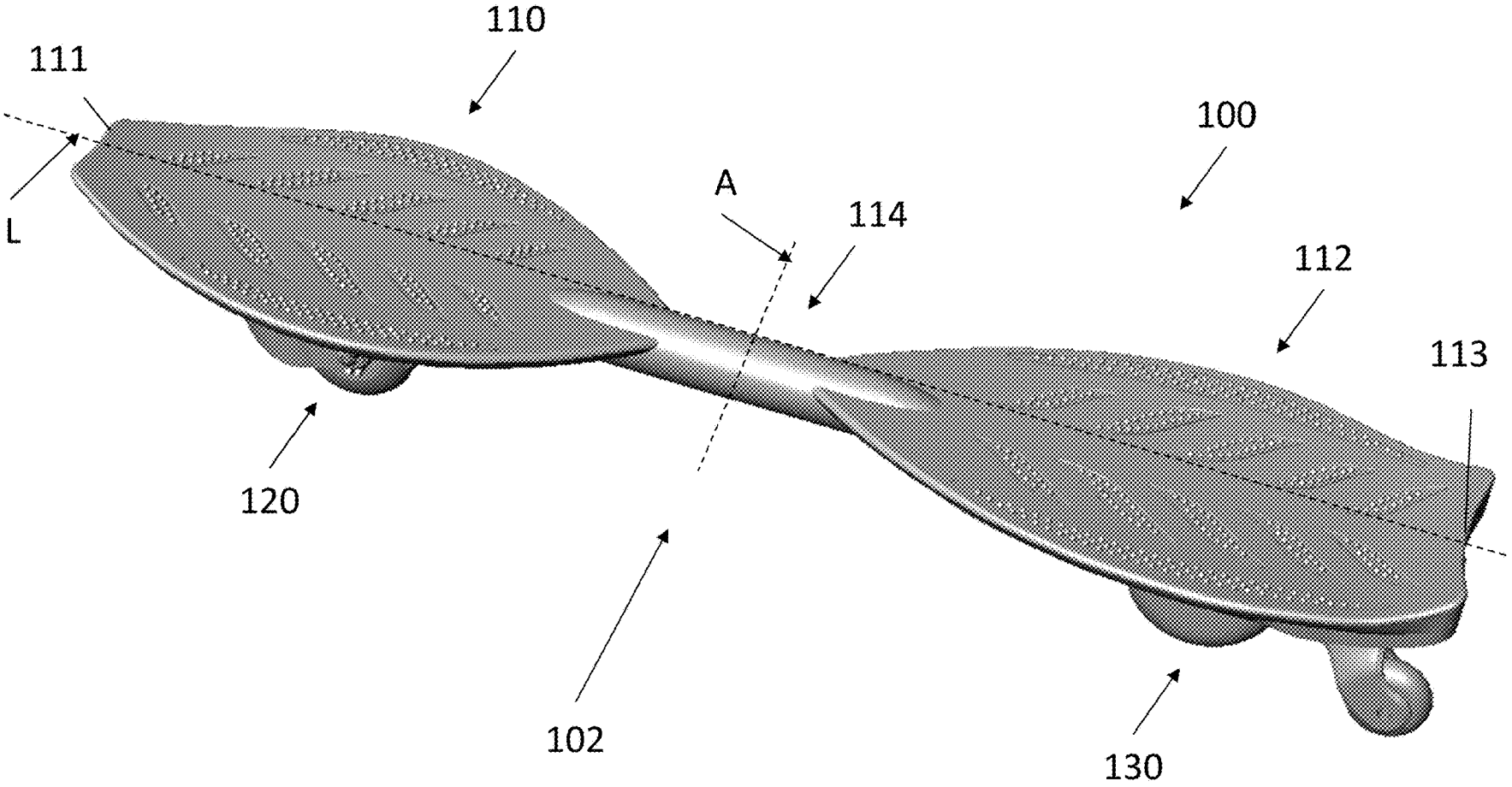
FIG. 1 illustrates a top perspective view of a powered board vehicle.
Figure 2:
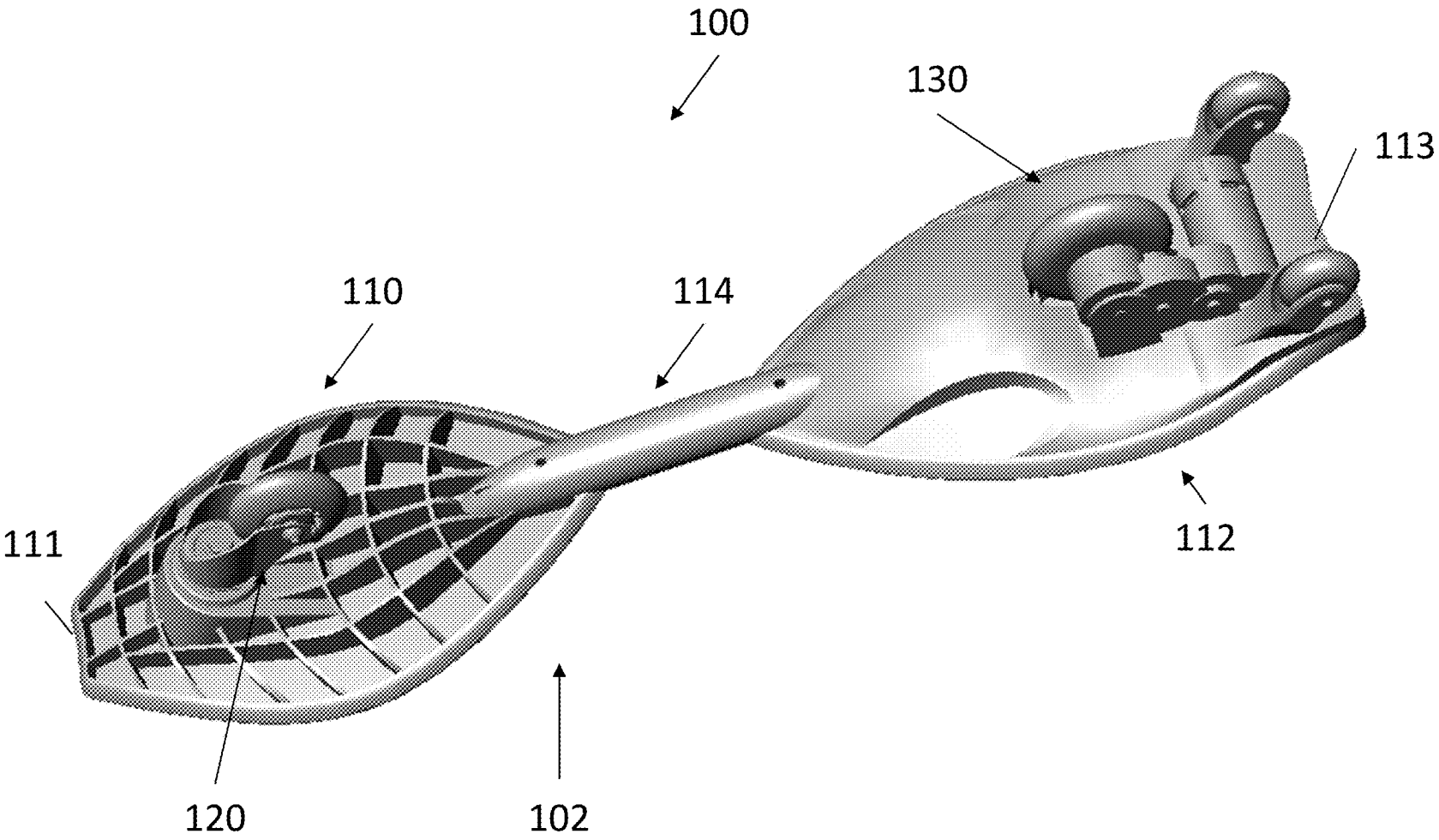
FIG. 2 illustrates a bottom perspective view of the powered board vehicle of FIG. 1.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Overview

Various embodiments of powered wheeled board vehicles are disclosed. As described in more detail below, the vehicles can include one or more powered rear wheels and one or more swivelable (e.g., caster) front wheels, among other wheels. Conventionally, this combination would be thought to render the vehicle inherently unstable, difficult to ride, and/or hard to control. This combination was typically thought to be particularly problematic when used on vehicles (e.g., skateboards) configured to permit twisting or flexing of the deck.

Furthermore, the addition of a powered rear wheel would typically be thought to negate the need for a swivelable front wheel. Some vehicles include swivelable front and rear wheels, as well as a deck that is configured to twist or flex, which can allow the user to create a locomotive force. But, with the addition of the powered rear wheel to provide the locomotive force, the swivelable front wheel would typically be thought to be unneeded. Accordingly, the swivelable front wheel would have been replaced with a fixed (e.g., non-swivelable) wheel, such as to reduce cost, increase stability, etc.

Additionally, it was conventionally thought that positioning a powered wheel in the front of certain vehicles was preferred to placing the powered wheel in the rear of the vehicle. For example, having the powered wheel in the rear of the vehicle could be thought to reduce controllability compared to having the powered wheel in the front.

Nevertheless, certain embodiments described herein have shown that a vehicle can include a powered rear wheel and one or more swivelable front wheels. In spite of the aforementioned and other concerns, such a vehicle can be sufficiently controllable and stable to provide an enjoyable riding experience.

Deck

FIGS. 1-8 illustrate an embodiment of a powered wheeled board vehicle 100. The vehicle 100 can include a deck 102, a front wheel assembly 120, and a rear wheel assembly 130.

The deck 102 can be of any suitable size, shape or arrangement. As illustrated in FIGS. 1-8, the deck 102 can include a first or forward portion 110 and a second or rearward portion 112. The forward portion 110 can connect with the front wheel assembly 120 and the rearward portion 112 can connect with the rear wheel assembly 130.

The forward portion 110 can be coupled to the rearward portion 112 by the neck portion 114. In some embodiments, the neck portion 114 rigidly couples the forward portion 110 to the rearward portion 112. In some embodiments, the neck portion 114 flexibly couples the forward portion 110 to the rearward portion 112.

In some embodiments, the neck portion 114 can be laterally narrower than the forward and rearward portions 110, 112. In various embodiments, the neck portion 114 is thinner in the lateral direction than the forward portion 110 and/or the rearward portion 112. For example, a ratio of the maximum lateral width of the forward portion 110 to the maximum lateral width of the neck portion 112 can be at least: 1.5:1, 2:1, 3:1, 4:1, or greater, among other ratios. In some embodiments, a ratio of the maximum lateral width of the rearward portion 112 to the maximum lateral width of the neck portion 112 can be at least: 1.5:1, 2:1, 3:1, 4:1, or greater, among other ratios. Some examples of configurations including a neck portion 114 are shown in FIGS. 1-14B, as well as in U.S. Pat. Nos. 7,338,056, 7,600,768 and 7,766,351, which are hereby incorporated by reference herein in their entirety.

In some configurations, a lateral axis A bisects the deck 102 at a midpoint of the neck portion 114. In some embodiments, the lateral axis A is orthogonal to a longitudinal axis L of the deck 102. In some embodiments, the rearward portion 112 has a shape and/or size that is substantially the same or similar to a shape and/or size of the forward portion 110. In some embodiments, the rearward portion 112 is larger than the forward portion 110. For example, the rearward portion 112 can have a length that is greater than a length of the forward portion 110. Certain such configurations can provide greater stability to the user while the user is being supported by the deck 102. In some embodiments, such configurations can provide easier steering controls to the user and/or allow the user to more easily tilt or twist the vehicle 100.

In some embodiments, the forward portion 110 has a front end 111 and the rearward portion 112 has a rear end 113. The rear end 113 can be wider than the front end 111. In some embodiments, the front end 111 and/or the rear end 113 are substantially concave. For example, an intermediate portion of the front end 111 and/or the rear end 113 can curve inwardly towards a lateral center of the deck 102 (e.g., a portion on the longitudinal axis L). In some embodiments, the front end 111 and/or the rear end 113 are substantially straight. In some embodiments, a portion of the forward portion 110 and/or the rearward portion 112 that connects with the neck portion 114 has a lateral width that is shorter than the front end 111 and/or the rear end 113.

In some embodiments, the rearward portion 112 has a maximum lateral width that is wider closer to the rear end 113 of the rearward portion 112 than to the neck portion 114. Some such configurations can provide enhanced support to the rear wheel assembly and/or to the user. Some such configurations can provide better stability to the user and/or provide a wider platform to secure the foot of the user in use.

In some embodiments, the neck portion 114 is substantially rigid. For example, the neck portion 114 can limit rotation of the rearward portion 112 relative to the forward portion 110 and/or the forward portion 110 relative to the rearward portion 112. In some embodiments, the neck portion 114 can allow the deck 102 to flex, twist, and/or tilt relative to the forward and/or rear portion 110, 112. In various embodiments, the deck 102 can flex, twist, and/or tilt in response to pressure from at least one of the user's feet, such as due to the user's weight shifting laterally on the deck 102. This can result in the forward portion 110 twisting and/or rotating relative to the rearward portion 112 in alternating directions about a longitudinal axis of the deck 102. The flex or twist of the deck 102 can be used to steer, control, and/or propel the vehicle 100. Further description of this feature can be found in at least U.S. Pat. Nos. 7,338,056, 7,600,768 and 7,766,351, which are hereby incorporated by reference herein in their entirety.

Front Wheel Assembly

FIGS. 1-8 illustrate the powered wheeled board vehicle 100 having a deck 102 connected with a front wheel assembly 120. The front wheel assembly 120 can include at least one front wheel 124. The front wheel 124 can be swivelably connected with a caster assembly 126. For example, the front wheel 124 can be a caster wheel. The caster assembly 126 can be coupled to and/or formed with the front wheel assembly mount 122. The caster assembly 126 can allow the front wheel 124 to swivel about a first axis and rotate about a second axis (e.g., generally orthogonal to the first axis).

In some embodiments, the front wheel 124 can be positioned approximately along a longitudinal axis of the vehicle 100 (for example, when the front wheel 124 is in a straight or neutral position). In some embodiments, the front wheel assembly 120 includes a biasing member, such as a spring, that biases the front wheel 124 towards the neutral position.

In some embodiments, the front wheel 124 can be positioned closer to a front end of the forward portion 110 than to the neck portion 114. In some embodiments, the front wheel 124 is positioned at approximately a center of the forward portion 110. In some embodiments, the front wheel assembly mount 122 is positioned closer to the front end of the forward portion 104 than to the neck portion 114 and the front wheel 124 is positioned at approximately a center of the forward portion. The front wheel assembly mount 122 can be inclined. For example, a portion of the mount 122 positioned closer to the front end 111 of the forward portion 104 can be positioned closer to the rolling surface than to a portion of the front wheel assembly 122 mount that is closer to the neck portion 114 when the vehicle 100 is substantially upright.

In some embodiments, the front wheel 124 can be angled. For example, the front wheel 124 can extend away from the front wheel assembly mount 122 at an angle. In some embodiments, when the front wheel 124 is in the neutral position, the front wheel 124 can be angled towards the rear end 113 of the rearward portion 112 (e.g., away from the front end 111 of the forward portion 110). In some embodiments, at least a portion of the front wheel 124 extends rearward of the front wheel assembly mount 122 when the front wheel 124 is in the neutral position. In some embodiments, an axle and/or the second axis of the front wheel 124 is positioned rearward of the front wheel assembly mount 122 when the front wheel 124 is in the neutral position.

Auxiliary Wheel Assembly

FIGS. 1-8 illustrate an embodiment of the vehicle having an auxiliary wheel assembly 180. The auxiliary wheel assembly 180 can include at least one auxiliary wheel 182 and an auxiliary wheel mount 184. As shown in the illustrated embodiment, the auxiliary wheel assembly 180 can include one or more (e.g., at least two auxiliary wheels 182). Some embodiments have one or more (e.g., at least two) auxiliary wheel mounts 184. In some embodiments, the auxiliary wheels 182 are caster wheels. In some embodiments, the auxiliary wheels 182 begin to spin when the wheels 182 touch the ground and the vehicle is already in motion. In some embodiments, the auxiliary wheels 182 can begin to rotate before the wheels 182 touch the ground. For example, in some embodiments, the auxiliary wheels 182 are powered, such as by the motor 152.

The auxiliary wheel mounts 184 can be coupled with the rearward housing portion 134. In some embodiments, the auxiliary wheel mounts 184 are integrally formed with the rearward housing portion 134. As shown, the auxiliary wheel mounts 184 can be positioned rearward at least a portion of the rear wheel assembly 180. In some embodiments, the auxiliary wheel mounts 184 can be spaced laterally from one another along a rear portion of the rearward housing portion 132. In some embodiments, the auxiliary wheel mounts 184 can be positioned adjacent lateral sides of the rearward housing portion 132. In some embodiments, the auxiliary wheel mounts 184 extend rearward from the rearward housing portion 132. In some embodiments, at least a portion of the auxiliary wheel mounts 184 and/or the auxiliary wheels 182 extends rearwardly beyond a rear side of the deck 102. In some embodiments, a rear-most portion of the auxiliary wheels 182 and/or the auxiliary wheel mounts 184 is approximately aligned with the rear end of the deck 102.

In some embodiments, the auxiliary wheel assembly 180 can be angled. For example, at least a portion of the auxiliary wheels 182 can be positioned rearward of a front end of the auxiliary wheel mounts 184. In some embodiments, the axis of rotation of the auxiliary wheels 182 is positioned rearward of the front end of the auxiliary wheel mounts 184. In some embodiments, the axis of rotation of the auxiliary wheels 182 can be positioned below the motor 152. In some embodiments, the axis of rotation of the auxiliary wheels 182 is approximately aligned with the axis of rotation of the rear wheel 134 along an axis that is parallel to the longitudinal axis L of the vehicle. In some embodiments, the auxiliary wheels 182 extend away from the auxiliary wheel assembly mounts 184 at an angle. In some embodiments, at least a portion of the auxiliary wheels 182 is positioned rearward of the rear wheel assembly 130. For example, at least a portion of the auxiliary wheels 182 can be positioned rearward of the motor 152.

In some embodiments, at least a portion of the auxiliary wheels 182 is positioned below an angled rear portion of the deck 102. In some embodiments, at least a portion of the auxiliary wheels 182 is positioned below a substantially straight portion of the deck 102 and the angled rear portion of the deck 102. In some embodiments, at least a portion of the auxiliary wheels 182 is positioned entirely below the substantially straight portion of the deck 102.

In some configurations, the auxiliary wheels 182 and the rear wheel 134 can have different diameters. For example, the rear wheel 134 can have a diameter that is at least twice the diameter of the auxiliary wheels 182. In some embodiments, the rear wheel 134 has a diameter that is at least three, four, or five or more times the diameter of the auxiliary wheels 182.

The auxiliary wheel mounts 184 can rotatably couple the auxiliary wheels 182. In some embodiments, the auxiliary wheel mounts 184 are in a forked shape such that the mounts 184 extend along at least a portion of lateral sides of the auxiliary wheels 182. The mounts 184 can be configured to allow rotation about an auxiliary wheel axis 186. In some embodiments, the auxiliary wheel mounts 184 are configured to inhibit or prevent rotation about an axis that is transverse to the auxiliary wheel axis 186. In some embodiments, the auxiliary wheels 182 are coupled to the auxiliary wheel mounts 184 by an auxiliary wheel axle 188. The auxiliary wheel axle 188 can extend through the auxiliary wheels 182 and at least a portion of the auxiliary mounts 184.

Figures 7, 8:
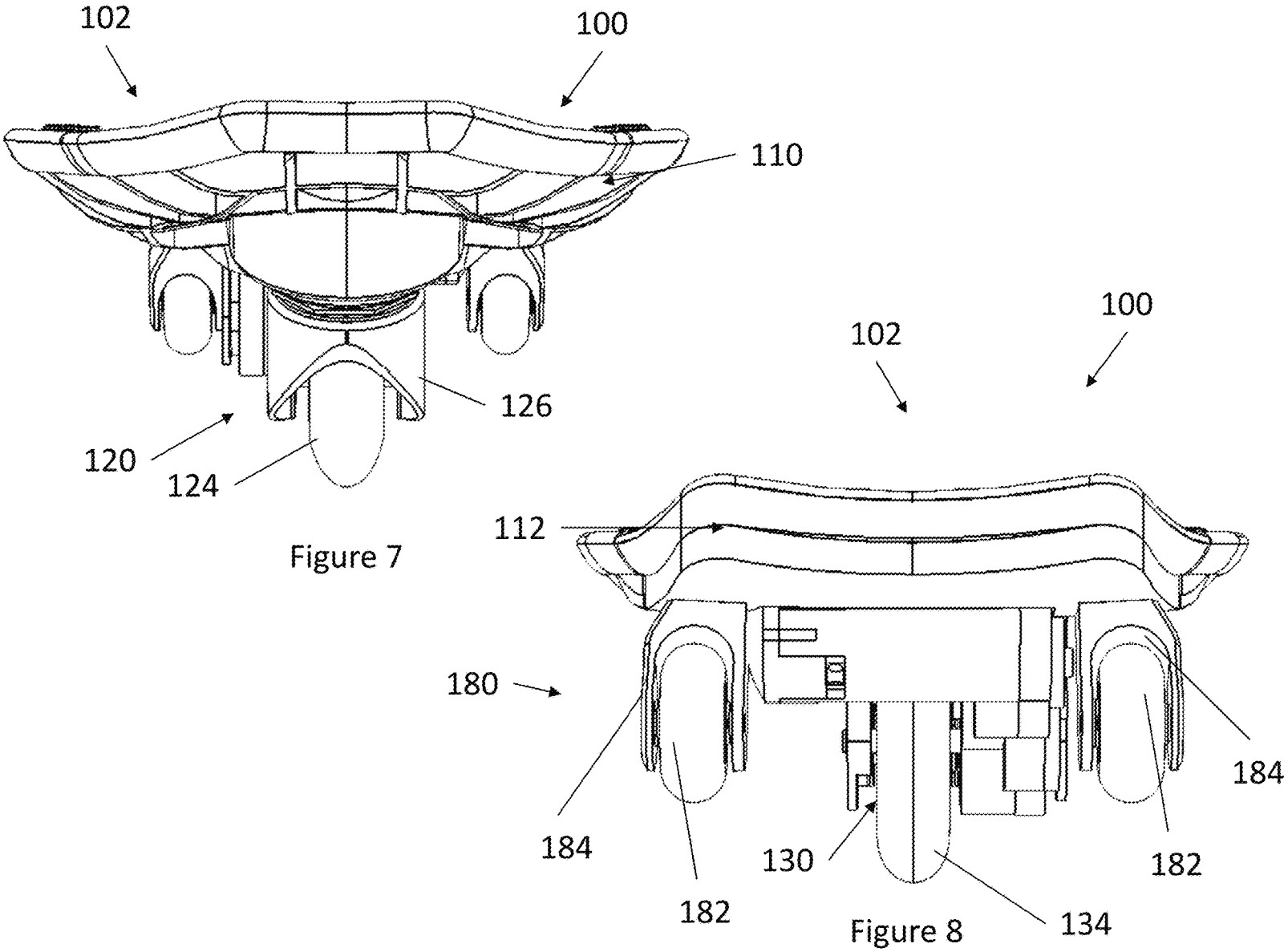
FIG. 7 illustrates a front view of the powered board vehicle of FIG. 1.
FIG. 8 illustrates a rear view of the powered board vehicle of FIG. 1.

In some embodiments, the auxiliary wheels 182 can provide additional stability and/or to the rearward portion 112 of the deck 102. This can beneficially provide easier steering controls to the user and/or allow the user to more easily tilt or twist. For example, as shown in FIGS. 7 and 8, the auxiliary wheels 182 can extend downwardly from the rearward housing portion 132 a distance less than the rear wheel 134. In such configurations, when the rear wheel 134 contacts the ground in use, one or both of the auxiliary wheels 182 may not contact the ground. In some embodiments, one or both of the auxiliary wheels 182 contacts the ground when the user tilts and/or twists the forward portion relative to the rearward portion. In some embodiments, one or both of the auxiliary wheels 182 contacts the ground when the user turns the vehicle 100. Thus, the auxiliary wheels 182 can help to prevent falls and/or help to keep the vehicle 100 in a generally upright position in use. Such configurations can help the user to balance while riding on the vehicle 100. In some embodiments, the auxiliary wheels 182 can help to inhibit a user from falling off of the vehicle 100, such as backwards to the rear of the vehicle and/or sideways to either side of the vehicle 100. In some embodiments, the auxiliary wheels 182 can limit the amount of front-to-rear tilt of the vehicle, such as during take-off and/or during slow down. In some embodiments, the auxiliary wheels 182 can allow for various tricks and/or styles of riding the vehicle.

Neck Portion

Figure 9A:
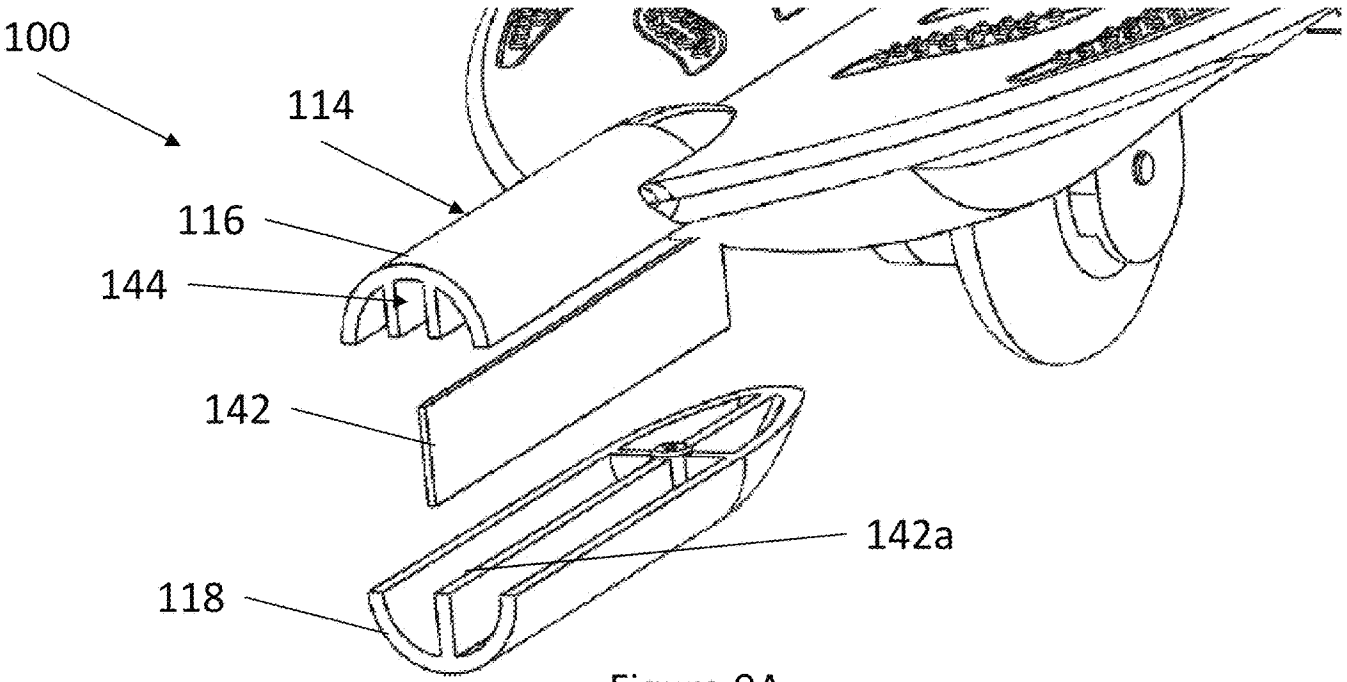
FIG. 9A illustrates an exploded cross-sectional perspective view of an embodiment of a neck portion of the powered board vehicle of FIG. 1.
Figure 9B:
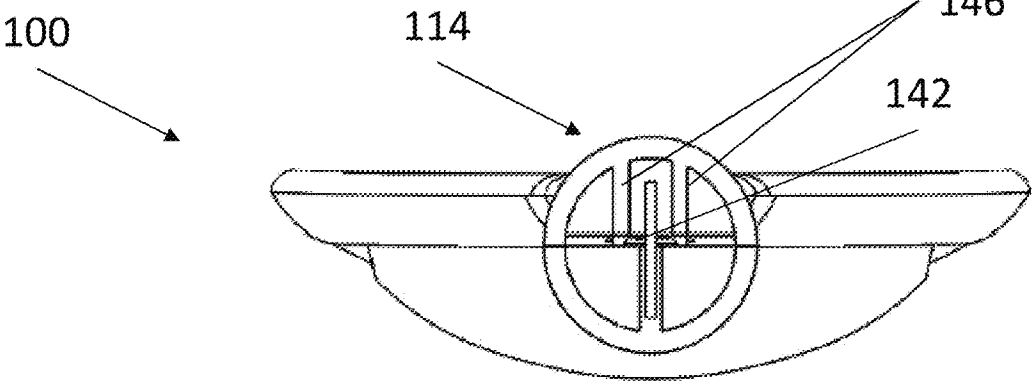
FIG. 9B illustrates a cross-sectional side view of the neck portion of FIG. 9A.

FIGS. 9A and 9B illustrate an embodiment of the neck portion 114. The neck portion 114 can include a top portion 116 and a bottom portion 118. The top portion 116 can be integrally formed with the forward portion 110 and/or the rearward portion 112. The top portion 116 can have a cross-sectional shape that is generally rounded, semi-circular, triangular, square, and/or rectangular, among other shapes. In some embodiments, the top portion 116 can extend upwardly above a top surface of the deck 102, such as a portion on the longitudinal axis L.

The bottom portion 118 can connect to the top portion 116 of the neck portion 114. In some embodiments, the bottom portion 118 can couple with the top portion 116 by a securement mechanism, such as a snap-fit arrangement, a clip, and/or an adhesive, among others. In some embodiments, the bottom portion 118 is removably coupled with the top portion 116. In some embodiments, the bottom portion 118 is fixed to the top portion 116 and/or integrally formed with the top portion 116.

The bottom portion 116 can have a cross-sectional shape that is rounded, semi-circular, triangular, square, and/or rectangular, among other shapes. In some embodiments, the neck portion 114, including the top portion 116 and the bottom portion 118 is generally cylindrical, among other shapes.

In some embodiments, the bottom portion 118 can engage the top portion 118 to form a housing surrounding an interior space. As shown, the neck portion 114 can include a biasing member such as a spring 142. The spring 142 can be positioned within the interior space of the neck portion 114. In some embodiments, the spring 142 is positioned within a spring slot 142*a* within the interior space of the neck portion 114. For example, the spring slot 142*a* can be formed in a protrusion that extends from an interior surface of the neck portion 114 (e.g., the bottom portion) towards the center of the interior of the neck portion 114. In some embodiments, the spring slot 142*a* can retain the spring 142 within the neck portion 114. In some embodiments, the spring 142 can provide support to the neck portion 114. In some embodiments, the spring 142 allows the forward portion 110 to flex, tilt, and/or twist relative to the rearward portion 112. The spring 142 can be configured to bias the neck 114, such as during twisting about the longitudinal axis. The spring 142 can include various types of springs. In some embodiments, the spring 142 comprises a plate that extends longitudinally along a length of the neck portion 114. In some embodiments, the spring 142 comprises a torsion spring.

As shown, in some embodiments, the spring 142 can be positioned within a slot 144 in the interior of the neck portion 114. As shown, the top portion 116 can include at least one guide 146. The top portion 116 can include at least two or more guides 146. The guides 146 can extend inwardly from the top portion 116 towards an interior space of the neck portion 114. In some embodiments, the guides 146 are substantially vertical relative to a longitudinal axis of the vehicle 100. The guides 146 can help to retain the spring 142 within the neck portion 114 approximately along a longitudinal axis of the vehicle 100.

Figure 10A:
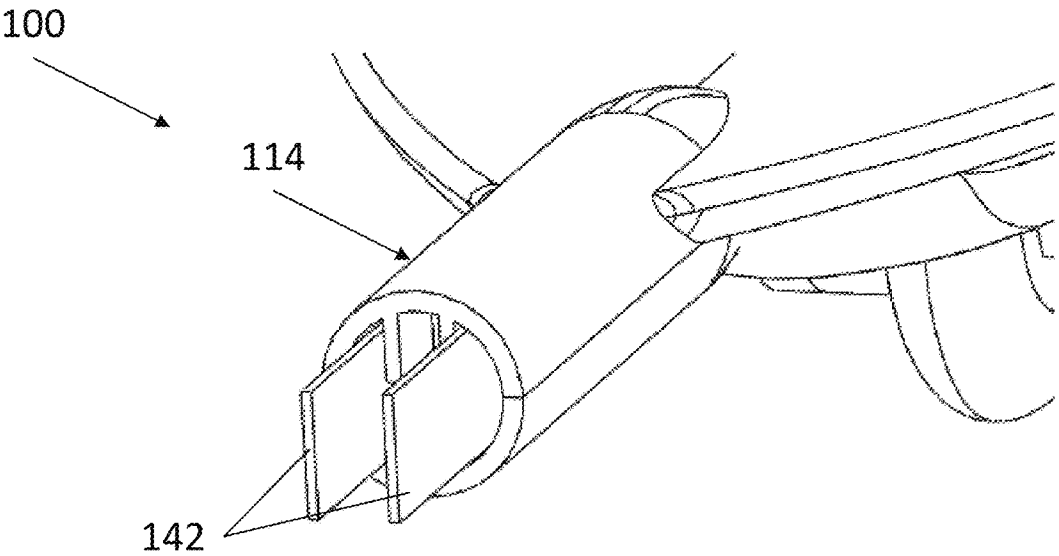
FIG. 10A illustrates a perspective view of another embodiment of a neck portion of the powered board vehicle of FIG. 1.
Figure 10B:
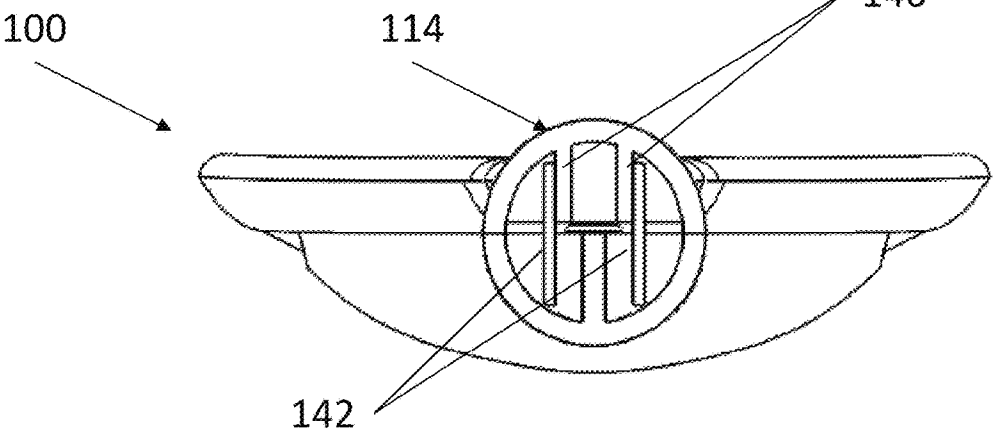
FIG. 10B illustrates a cross-sectional side view of the neck portion of FIG. 10A.

FIGS. 10A and 10B illustrate an embodiment of the neck portion 114. As shown, the neck portion 114 can include two or more springs 142 positioned within an interior space of the neck portion 114. In some embodiments, the neck portion 114 includes three, four, five, or six or more springs 142. As shown in the illustrated embodiments, the springs 142 can be positioned within slots formed between the guides 146 of the top portion 116 and outer side walls of the neck portion 114. A plurality of springs 142, rather than a single spring, can reduce the size of the springs and/or the neck portion 114.

Support Surface

Figures 11A, 11B, 11C:
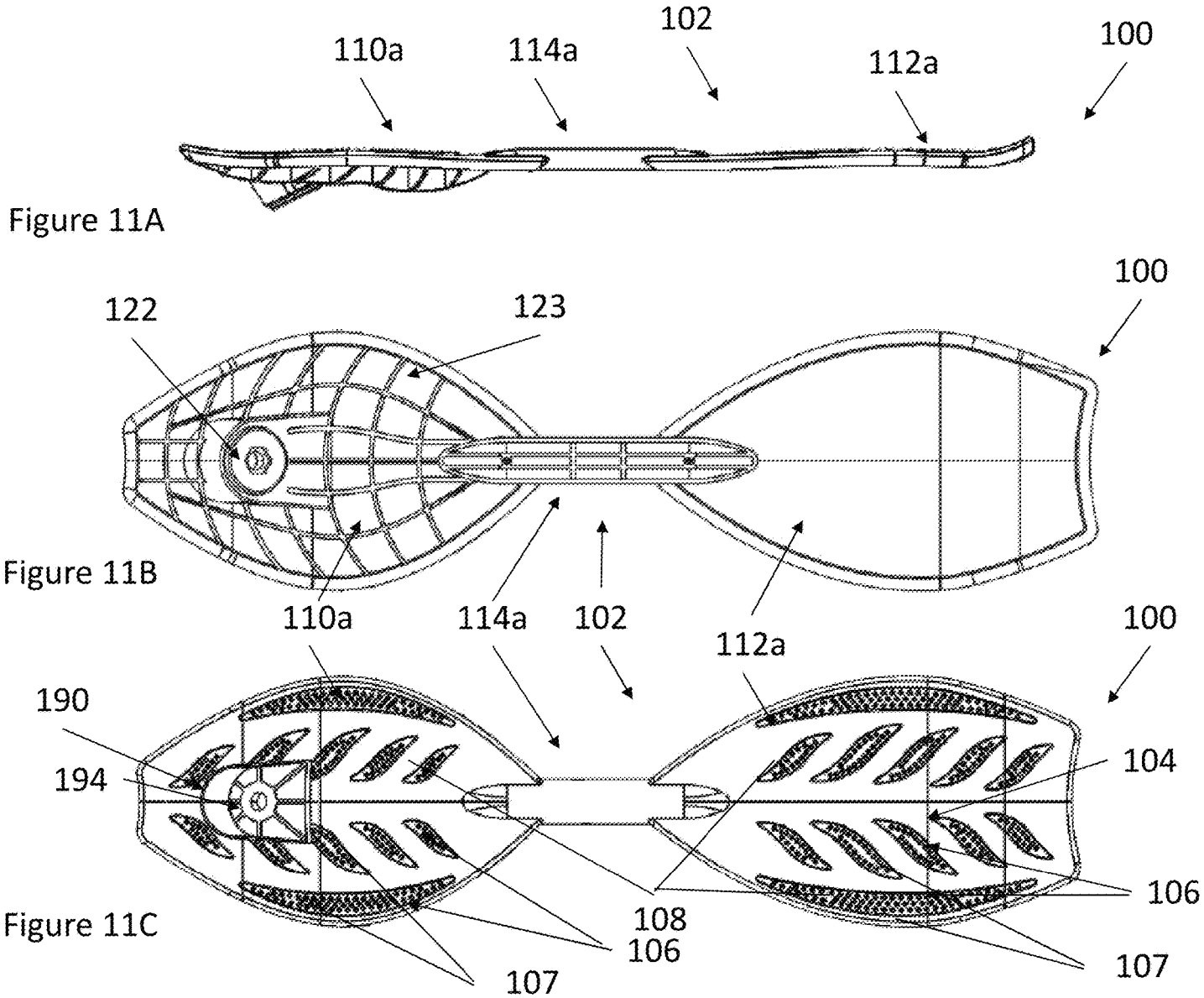
FIG. 11A illustrates a side view of a top portion of a deck of the powered board vehicle of FIG. 1.
FIG. 11B illustrates a bottom view of the top portion of the deck of the powered board vehicle of FIG. 1.
FIG. 11C illustrates a top view of the top portion of the deck of the powered board vehicle of FIG. 1.

The deck 102 can include a support surface 104. FIGS. 11A-11C illustrate an embodiment of the support surface 104. The support surface 104 can be configured to support at least one foot of a user. In some embodiments, the support surface 104 can be configured to accommodate both feet of a user, such as in one or both of a forward-and-rearward and/or a side-by-side arrangement.

In some embodiments, the support surface 104 includes a grip portion 106. The grip portion 106 can include a plurality of grips 107. The plurality of grips 106 can help to secure a user's foot to the support surface 104. In some embodiments, the plurality of grips 106 can help to prevent and/or limit sliding movement of a user's foot along the support surface 104. Such configurations can help to limit slipping and/or falling off of the vehicle 100 in use.

In some embodiments, the support surface 104 can include a plurality of lights 108. The plurality of lights (e.g., LEDs) can light up. The lights 108 can be configured to turn on as the front and/or rear wheels begin to spin. A characteristic of the lights can change as a function of wheel speed and/or direction. For example, in some embodiments, the lights 108 can get brighter as the front and/or rear wheels spin faster. In some embodiments, the lights 108 can be turned on or off before, during, and/or after the vehicle 100 is in use.

In some embodiments, the support surface 104 can form a unitary body. As previously mentioned, the deck 102 can include a forward portion 110, a rearward portion 112, and a neck portion 114. In some embodiments, the support surface 104 can include a forward portion 110*a*, a rearward portion 112*a*, and a neck portion 114*a*. The forward portion 110*a*, the rearward portion 112*a*, and/or the neck portion 114*a* of the support surface 104 can be the same or similar to the forward portion 110, the rearward portion 112, and a neck portion 114, and can include many of the same features. As shown, the forward portion 110*a* and the rearward portion 112*a* can be spaced apart and/or connected by the neck portion 114*a*.

In some embodiments, the support surface 104 includes a front wheel assembly mount 122. The front wheel assembly mount 122 can be integrally formed with or otherwise coupled to a bottom surface of the forward portion 110*a*. The front wheel assembly mount 122 can be configured to support the front wheel assembly 120, as discussed in more detail below. In some embodiments, a bottom surface of the forward portion 110*a* can include a plurality of ribs or fins 123. In some embodiments, the ribs 123 can provide structure support, increase rigidity, increase airflow, increase the speed of the vehicle 100, and/or increase the efficiency of the motor in use.

In some embodiments, the neck portion 114*a* can form the top portion 116 of the neck portion 114. The bottom surface of the neck portion 114*a* can be configured to receive a bottom portion 116, as discussed above.

In some embodiments, the rearward portion 112*a* can include a bottom surface. The bottom surface of the rearward portion 112*a* can be substantially flat. In some embodiments, the bottom surface of the rearward portion 112*a* is curved, such as concave or convex. The bottom surface of the rearward portion 112*a* can be configured to receive a rearward housing portion 132. The rearward housing portion 132 can be removably coupled to the rearward portion 112*a*. In some embodiments, a bottom surface of the rearward portion 112*a* includes a lip. The lip can engage an outer edge of the rearward housing portion 132. In some embodiments, the rearward housing portion 132 is permanently fixed to the rearward portion 112*a*. In some embodiments, the rear wheel assembly 130 is not coupled directly with the bottom surface of the rearward portion 112*a*. In some embodiments, the rearward housing portion 132 can support the rear wheel assembly 130, as discussed in more detail below.

In some embodiments, the rearward housing portion 132 can include a plurality of recesses 164. In some embodiments, the recesses 164 can increase airflow between the rearward housing portion 132 and the support surface 104 of the deck 102. In some embodiments, the recesses 164 can allow access to at least one or more of the controller, the battery, the rear drive assembly, among other components positioned at least partially within an interior space formed between the rearward housing portion 132 and the rearward portion 114*a* of the support surface 104. In some embodiments, the recesses 164 comprise apertures.

Rear Wheel Assembly

Figure 12:
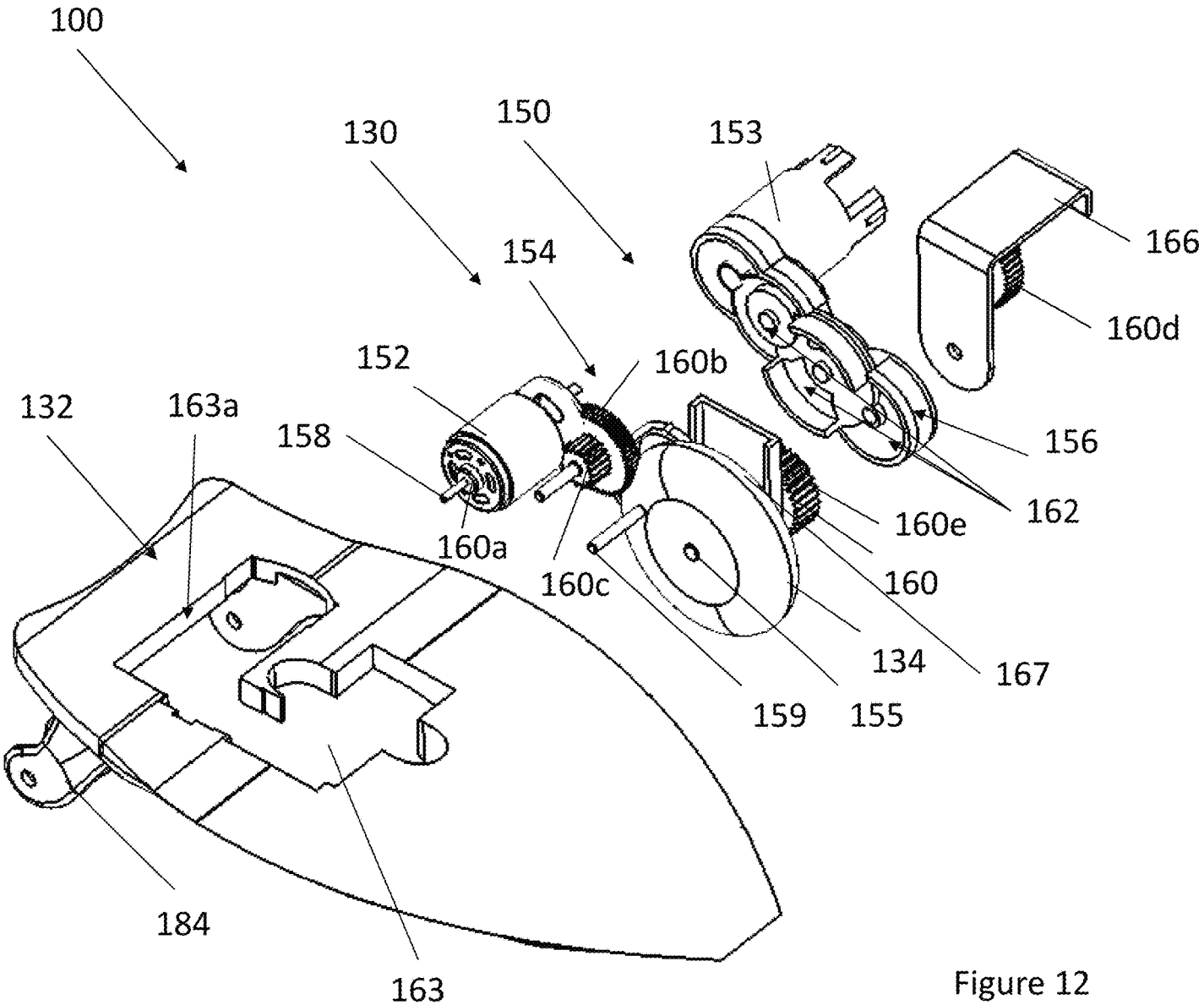
FIG. 12 illustrates an exploded view of an embodiment of a rear wheel assembly of the powered board vehicle of FIG. 1.

As previously mentioned, the powered wheeled board vehicle 100 can include a deck 102 connected with a rear wheel assembly 130. As shown in FIG. 12, the rear wheel assembly 130 can be connected to the rearward portion 112. The rearward portion 112 can include a rearward housing portion 132. As discussed above, the rearward housing portion 132 can support the rear wheel assembly 130, as shown in FIG. 12. The rear wheel assembly 130 can include a rear wheel 134 and a rear wheel mount 136.

In some embodiments, the rear wheel 134 is powered, such as by an electric motor, as discussed below. The rear wheel 134 can be fixed in orientation relative to the deck 102. In some variants, the orientation of the rear wheel 134 is movable relative to the deck 102. The rear wheel 134 can be approximately aligned with and/or positioned on a longitudinal axis of the vehicle 100 (for example, when the front wheel 124 is in a straight or neutral position). In some configurations, the front wheel 124 and the rear wheel 134 can have different diameters. For example, the rear wheel 134 can have a diameter that is at least twice the diameter of the front wheel 124. In some configurations, the front and rear wheels 124, 134 may have substantially the same or the same diameter.

In some embodiments, the rear wheel assembly 130 includes a rear drive assembly 150. The rear drive assembly 150 can include a motor 152. In some embodiments, the motor 152 can be contained in a protective shell, such as a generally cylindrical casing 153. The casing 153 can include one or more apertures, such as to allow airflow from ambient to the motor 152 for cooling. In some embodiments, the motor 152 may be a hub motor similar to those described in U.S. Patent Publication No. 2015/0133253, which is incorporated by reference herein in its entirety. In certain embodiments, the motor 152 may be a small toy motor, such as those used to drive electric motor-driven toys.

The motor 152 can drive the rear wheel 134. In certain embodiments, torque from the motor 152 is transmitted to the rear wheel 134 via a transmission, such as a gear set or gear assembly 154. In some embodiments, the gear assembly 154 can be housed in a gear assembly housing 156. As shown, the gear assembly housing 156 can include a plurality of recesses 162. Each of the recesses 162 can be shaped to receive and/or house a corresponding gear 160 of the gear assembly 154. In some embodiments, the gear assembly housing 156 can include a stepped configuration. For example, the gear assembly housing 156 can include the recesses 162 located at various lateral positions based on the location of the corresponding gear 160 within the gear assembly 162. In some embodiments, as illustrated, the stepped recesses of the gear assembly housing 156 can have respective outer surfaces that are laterally offset (e.g., non-coplanar) from each other.

In some embodiments, the gear assembly housing 156 can include a first portion configured to be positioned at and/or at least partially surround the gears 160. In some embodiments, the gear assembly housing 156 can include a second portion configured to be positioned at an opposite side from the first portion. The second portion can engage the first portion by, for example, a mechanical fastener and/or a snap-fit configuration, to form the gear assembly housing 156 and define an interior space in which the gear assembly 154 is positioned. In some embodiments, the second portion surrounds at least a portion of the gears 160 of the gear assembly 154. In some embodiments, the second portion is removable from the first portion to allow access to the gear assembly 154.

In some embodiments, the gear assembly housing 156 and the casing 153 form a unitary and/or integral unit. In other embodiments, the cylindrical casing 153 is separate from the gear assembly housing 156.

As shown in the exploded view of the rear drive assembly 150 of FIG. 12, the gear assembly 154 can include a plurality of gears 160 (e.g., a worm gear, spur gear, etc.). The gears 160 can be used to convert the torque produced by the motor 152 into a torque that is used to power the rear wheel 134. In some embodiments, the gear assembly 154 includes one, two, three, four, five, six, seven, eight, or nine or more gears 160. Through the sequence of gears 160, the torque of the motor 152 can be changed (e.g., increased or reduced) to drive the rear wheel via the rear wheel axle 155.

In some embodiments, the motor 152 drives a motor shaft 158, such as a driving shaft. In some embodiments, a gear 160*a* of the gear assembly 154 is mounted on the shaft 158 and a gear 160*e* of the gear assembly 154 is mounted on the rear wheel axis 155. The gears 160*a*, 160*e* can be operably connected through intermediate gears, such as gears 160*b*, 160*c*, 160*d*. Through the sequence of gears 160*a*-160*e*, the torque of the motor 152 can be adjusted to drive the rear wheel 134 via the rear wheel axis 155.

Referring back to FIG. 8, a rear view of the vehicle 100 is shown. As shown, the gear assembly 154 can be positioned offset from a longitudinal axis of the vehicle 100. For example, all or a portion of the gears 160 can be positioned on a first side of the longitudinal axis of the vehicle 100. In some embodiments, all or a portion of the gears 160 can be positioned on a first side of the rear wheel 134. As shown, in some embodiments, the motor 152 can be positioned behind the rear wheel 134. In some embodiments, a center of the motor 152 can be substantially aligned with the longitudinal axis of the vehicle 100. In some embodiments, the motor 152 can be positioned approximately perpendicular to the longitudinal axis of the vehicle 100. In some embodiments, the motor 152 can extend between at least a portion of the auxiliary wheel assembly 180, such as the auxiliary wheels 182 and/or the auxiliary wheel mounts 184. In some embodiments, the motor can be configured to pass through a motor slot 163*a* in the rearward housing portion 132, as illustrated in FIG. 12.

Returning to FIG. 12 again, in some embodiments, the rear drive assembly includes a plurality of gear shafts 159. The gear shafts 159 can be configured to pass through and be rotatably coupled with the gears 160. The gear shafts 159 can extend from a first side housing 166 to a second side housing 167 of the rear wheel mount 136. A rear wheel axle 155 can extend from the first side housing 166 to the second side housing 167. In some embodiments, the rear wheel axle 155 is coupled with the first side housing 166 and/or the second side housing 167. In some embodiments, the rear wheel axle 155 is fixed to the first side housing 166 at a first end. In some embodiments, the rear wheel axle 155 is removably coupled with the second side housing 167.

As shown in FIGS. 13A-14B, the first side housing 166 can be coupled with the gear assembly housing 156 at a first side. In some embodiments, the first side housing 166 can be coupled with the rear wheel axle 155. In some embodiments, the first side housing 166 is generally U-shaped. In some embodiments, the first side housing 166 is generally L-shaped. As shown, the first side housing 166 can include a first portion 166*a*, a second portion 166*b*, and/or a third portion 166*c*. In some embodiments, the first portion 166*a* can extend downwardly relative to the deck 102. In some embodiments, the first portion 166*a* is approximately perpendicular to the rear wheel axle 155. In some embodiments, the first portion 166*a* extends from the first side of the rear wheel assembly housing beyond an outer diameter of the rear wheel 134 when assembled. In some embodiments, the second portion 166*b* extends from an end of the first portion 166*a*. The second portion 166*b* can be integrally formed with the first portion 166*a*. In some embodiments, the second portion 166*b* extends approximately horizontal relative to the first portion 166*a*. For example, in some embodiments, the second portion 166*b* extend from the first portion 166*a* at approximately a 90 degree angle. In some embodiments, the second portion 166*b* is substantially parallel to a top surface of the deck 102. The second portion can extend from the first portion 166*a* positioned on one side of the rear wheel 134 beyond the other side of the rear wheel 134.

In some embodiments, the third portion 166*c* extends from the second portion 166*b*. The third portion 166*c* can extend at approximately a 90 degree angle from the second portion 166*b*. In some embodiments, the third portion 166*c* extends from the second portion 166*b* at another angle, such as 60 degrees, 70 degrees, or 80 degrees or more. In some embodiments, the third portion 166*c* is approximately parallel to the first portion 166*a*. For example, the third portion 166*c* can be approximately perpendicular to a longitudinal axis of the vehicle 100. As shown, the third portion 166*c* may extend upwardly from the second portion 166*b* by a length that is less than a length of the first portion 166*a*. In some embodiments, the third portion 166*c* extends upwardly to a vertical position just below an outer circumference of the rear wheel 134. In some embodiments, the third portion 166*c* extends upwardly towards the deck 152 such that at least a portion of the third portion 166*c* extends upwardly over at least a portion of the rear wheel 134.

The second side housing 167 can be removably coupled to at least a portion of the first side housing 166 to surround the rear wheel 134. As shown, at least a portion of the second side housing 167 can couple with at least the third portion 166*c* of the first side housing 166. In some embodiments, the second side housing 167 can include a slot to slide over the third portion 166*c*. In some embodiments, the second side housing 167 can engage the third portion 166*c* by a snap-fit configuration, mechanical fastener, or other coupling mechanism. In some embodiments, the second side housing 167 can include a hole configured to receive at least a portion of the rear wheel axle 155.

The rearward housing portion 132 can include the slot 163. The slot 163 can receive at least a portion of the rear wheel assembly 130. In some embodiments, the rear wheel assembly 130 can be secured to the deck through the slot 163 such that at least a portion of the rear wheel assembly extends through the slot 163.

Figures 13A, 13B, 14A, 14B:
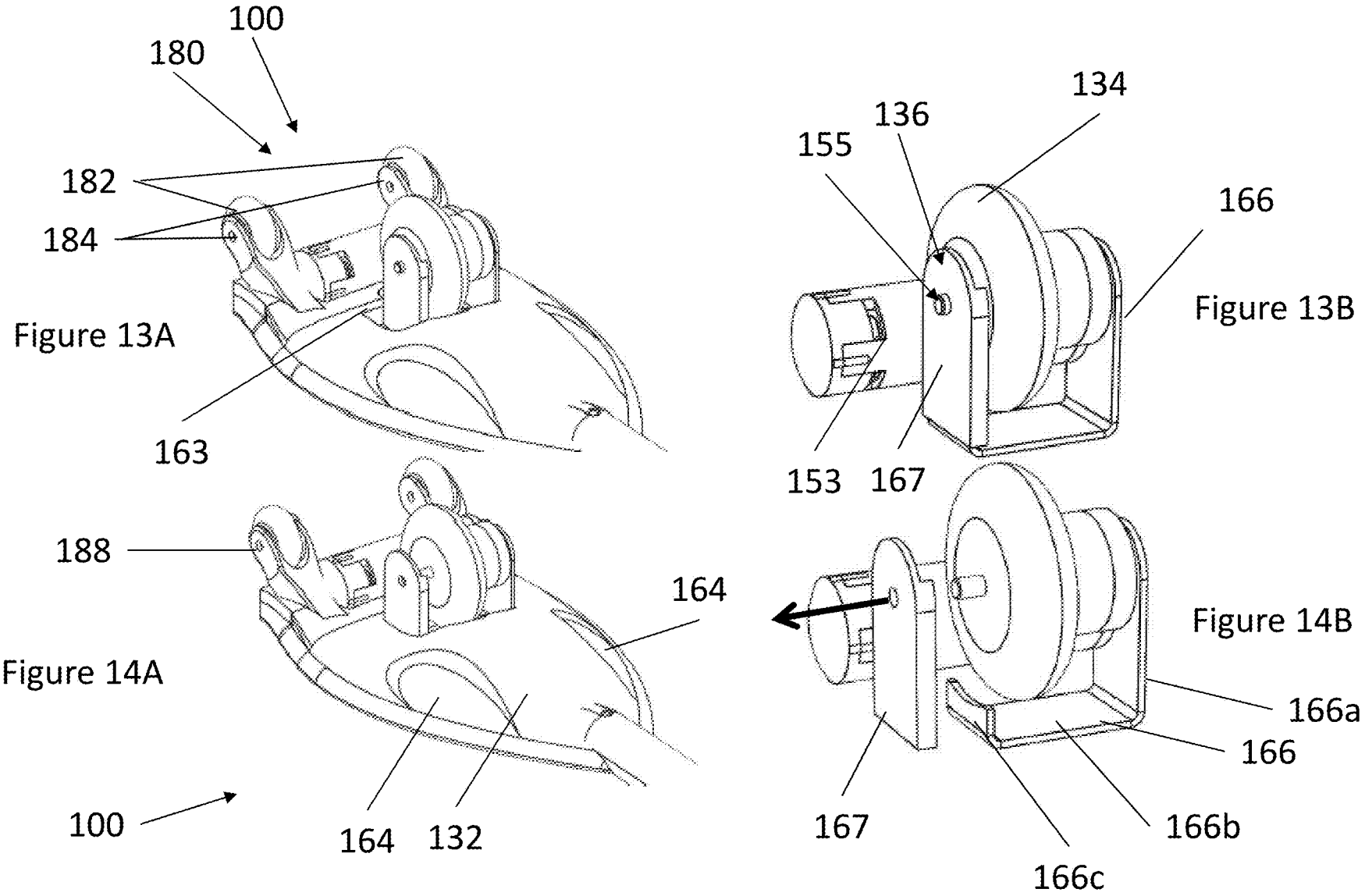
FIG. 13A illustrates a bottom perspective view of a rear portion of the powered board vehicle of FIG. 1 in a first position.
FIG. 13B illustrates a close-up view of a gear box of the powered board vehicle of FIG. 13A.
FIG. 14A illustrates a bottom perspective view of the rear portion of the powered board vehicle of FIG. 1 in a second position.
FIG. 14B illustrates a close-up view of the gear box of the powered board vehicle of FIG. 14A.

FIGS. 13A-13B illustrate an embodiment of the rear wheel assembly 130 in a first position, such as a neutral position. As shown, the first side housing 166 can be positioned adjacent a first side of the slot 163. In some embodiments, the first side housing 166 can be fixed to the first side of the slot 163. In some embodiments, the first side housing 166 can be configured to remain in the first position. In the first position, as shown, the second side housing 167 can be coupled with the first side housing 166. In some embodiments, in the first position, the shaft 159 and/or axle 155 is received in the hole in the second side housing 167. The first side housing 166 can be positioned offset from a second side of the slot 163. The first side housing 166 can be positioned flush with the first side of the slot 163. In some embodiments, the second side housing 167 can be positioned offset from the second side of the slot 163 such that the second side housing 167 is spaced apart from the first side of the slot 163 in the neutral position.

FIGS. 14A-14B illustrate an embodiment of the rear wheel assembly 130 in a second position. As shown in FIG. 14A, the second side housing 167 has been decoupled from or otherwise disengaged from the first side housing 166. When the second side housing 167 disengages from the first side housing 166, the second side housing 167 can translate laterally along the slot 163 to expose a second end of the rear wheel axle 155. In some embodiments, the second side housing 167 is positioned adjacent the second side of the slot 163 in the second position.

Such configurations can allow the rear wheel 134 to be removed and/or replaced. When the vehicle is used for a certain amount of time, the rear wheel 134 may become damaged, and/or begin to wear. The rear wheel mount 136 can beneficially allow the rear wheel to be accessed. In some embodiments, such configurations can allow the rear wheel 134 to be easily removed and/or replaced. In some embodiments, various rear wheels 134 having various shapes, sizes, and/or colors can be implemented in the vehicle 100. The configurations described herein can advantageously accommodate rear wheels 134 having various shapes, sizes, and/or colors. For example, a user may want to change a rear wheel 134 having one color to a rear wheel having another color. The configurations described herein allow the user to easily remove and/or replace the rear wheel 134. Once the rear wheel 134 is replaced, the second side housing 167 can translate laterally along the slot 163 towards the first side housing 166 and engage with the first side housing 166 to secure the rear wheel assembly 130.

Motor and Throttle Assembly.

In some embodiments, the vehicle 100 includes a control mechanism, such as a wireless throttle remote assembly. The wireless throttle remote assembly 135 can include a throttle that can be toggled by the user to increase or decrease the speed of the motor 134 to increase or decrease the speed of the vehicle 100. In some embodiments, the throttle assembly can be wireless; however, in other embodiments, the throttle assembly 135 is wired to a motor and/or a battery.

Figure 3:
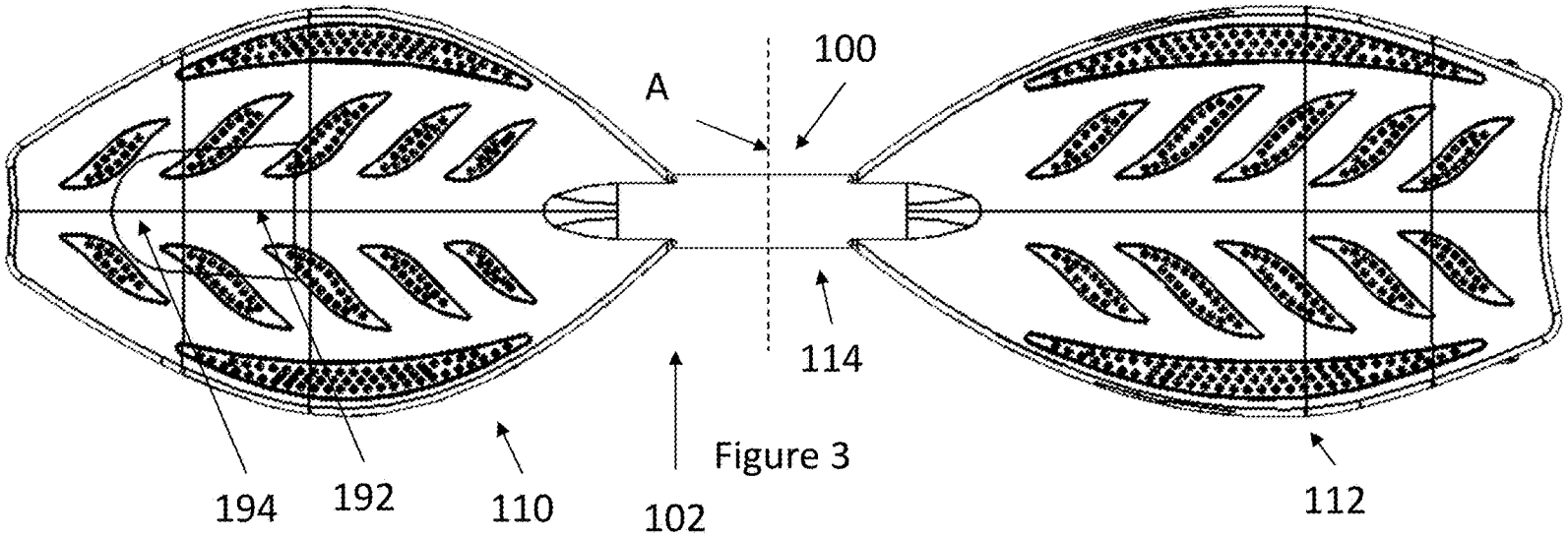
FIG. 3 illustrates a top view of the powered board vehicle of FIG. 1.
Figure 4:
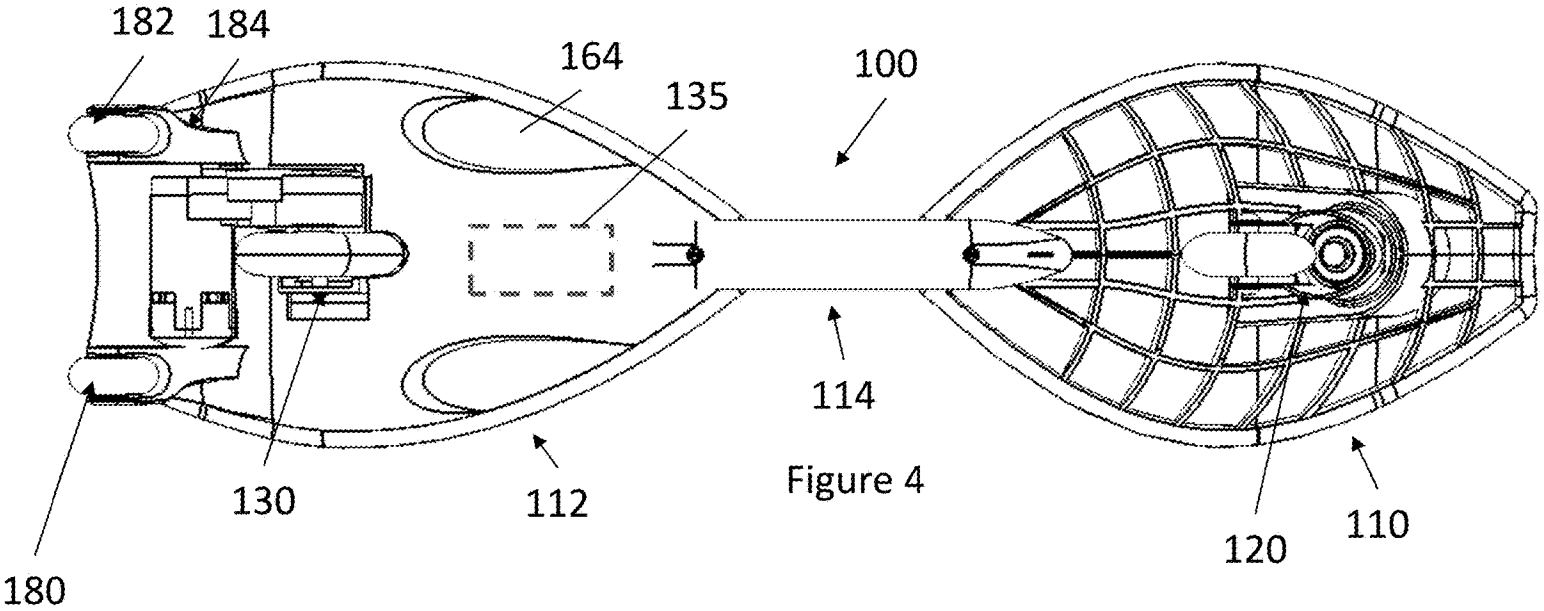
FIG. 4 illustrates a bottom view of the powered board vehicle of FIG. 1.
Figure 5:
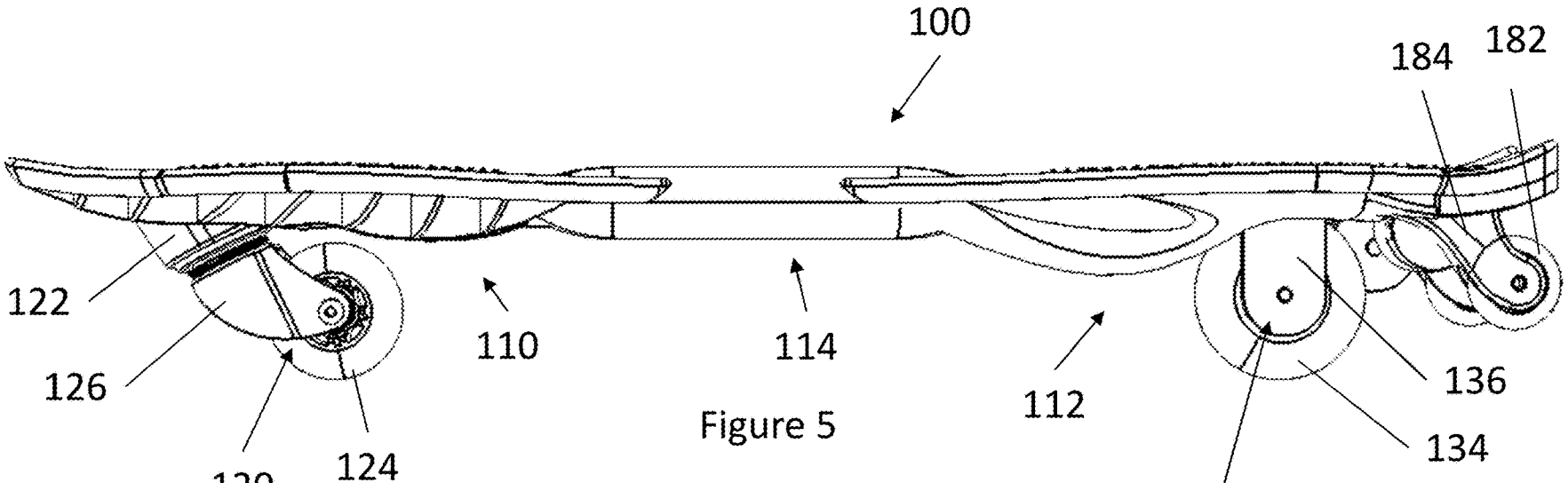
FIG. 5 illustrates a first side view of the powered board vehicle of FIG. 1.
Figure 6:
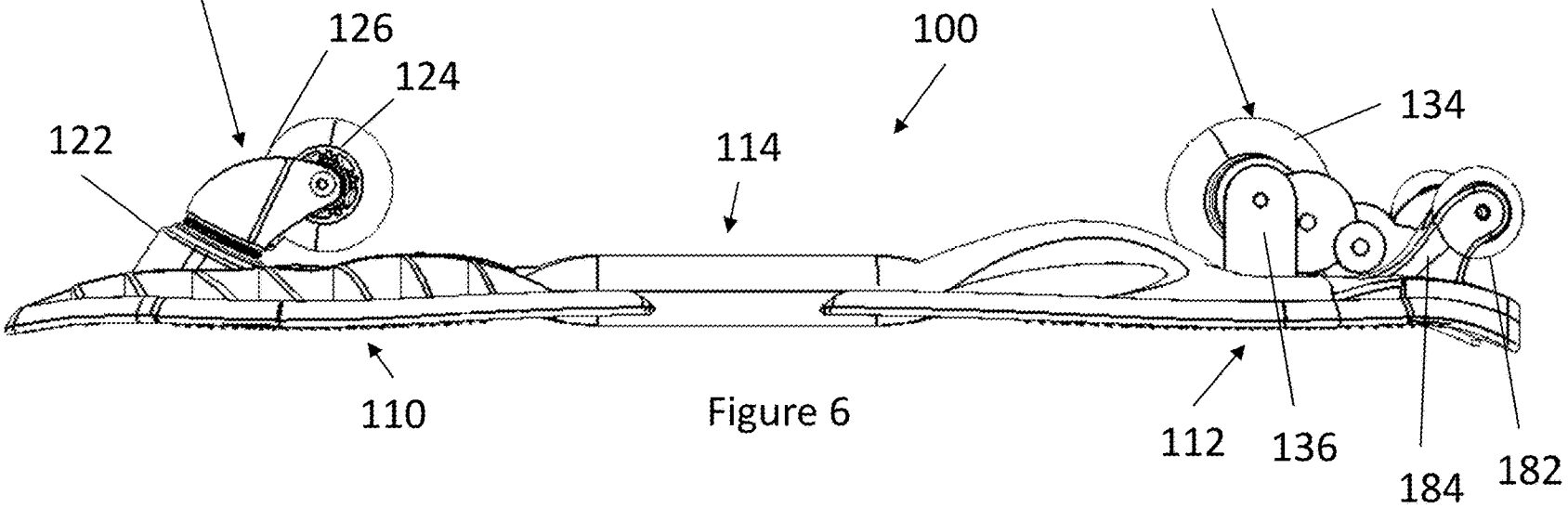
FIG. 6 illustrates a second side view of the powered board vehicle of FIG. 1.

In some embodiments, the throttle assembly 135 may be connected to a braking assembly through a wireless and/or a mechanical connection to slow or stop the vehicle 100. In some embodiments, the vehicle 100 comprises a braking button, switch, lever, or other actuator available to the hand or the foot of the user while the user operates the vehicle. For example, as shown in FIG. 3, the support surface 104 can include a brake aperture 190 to receive a braking actuator 192. Depressing the braking actuator can slow or stop the front wheel, which can slow or stop the vehicle 100. In some embodiments, the braking functionality is provided by the motor. In some variants, the brake comprises a drum brake, disk brake, caliper brake, or otherwise. In some embodiments, the brake is positioned at the forward portion 110 and/or the rearward portion 112. In some embodiments, the vehicle 100 includes a brake actuator 192 positioned near the front and/or rear wheel. For example, the brake can be configured to cause the front wheel and/or the rear wheel to slow down or stop when the brake actuator 192 is actuated.

In some embodiments, the motor can be controlled by a throttle actuator 194*a* that can be depressed through a throttle aperture 194 in the deck 102. For example, a user can depress the throttle positioned within the throttle aperture to provide instructions to the controller to supply power to the motor. For example, the throttle actuator 194*a* can be depressed. When the throttle actuator 194*a* is depressed through the throttle aperture 194, the motor is configured to instruct the controller to supply power to the motor. In some embodiments, the throttle actuator 194*a* can be positioned in the rearward portion of the vehicle 100. In some embodiments, the throttle 194*a* can be configured to instruct the controller to supply power to the motor and/or the rear wheel.

In some embodiments, the motor 134 can be controlled by a wired or wireless remote control. The remote control can include a transmitter and a trigger or other suitable control(s). Movement of the trigger and/or the amount of movement of the trigger can be detected, such as by a sensor in the remote control. This information can be used (e.g., by a processor or in the remote control or on the vehicle 100) to determine an amount of motive power to be provided by the motor. In some embodiments, the transmitter can transmit a signal corresponding to the amount of trigger movement and a receiver on the vehicle 100 can receive the signal, which can be used to control the motor. In some embodiments, the trigger comprises an accelerator to control motive power provided by the motor. Although a "pistol-grip" style of remote control can be used, other configurations are contemplated as well, such as a button, switch, joystick, toggle, slider, trackball, smartphone app, or otherwise. In some configurations, the remote control is the only element of the vehicle 100 that is controlled with a hand. For example, in some implementations, although the throttle can be controlled via remote control, the user can control all other aspects of the vehicle 100 with his or her feet in a manner similar to a normal or caster skateboard. In at least some configurations, the vehicle 100 may not include a handlebar or other hand support that is connected to the deck 102 or other portion of the vehicle 100.

In contrast to certain powered vehicles with controls on handlebars or other supports, the remote control can allow a user to move both of his or her hands during operation of the vehicle, while still being able to control locomotion of the vehicle. In some embodiments, the remote control can be configured to be held and operated by a single hand. In some embodiments, the remote control can facilitate user safety, such as by not restraining the user's hands to handlebars or other supports, and instead readily allowing the user to move his or her hands to catch the user in the case of a fall.

Some embodiments of the vehicle 100 includes at least one battery. In some embodiments, the battery can be mounted to the underside of the support surface 104 and/or positioned within the rearward housing portion 132. In some embodiments, the battery is insertable and/or removable from the housing portion 132. The battery may be any type of battery, such as a lithium ion rechargeable battery. For example, the battery can have an approximate 1.5-2.5 hour discharge time.

In various embodiments, the controller can receive a signal from the throttle assembly. For example, the controller can receive a signal indicative of the amount of speed and/or power to apply to the rear wheel 134. The controller can provide two-way or one-way transmission to the motor 132. For example, the controller can instruct the motor to drive the wheel 134 in response to and/or consistent with the signal from the throttle assembly. While control of the vehicle 100 can be wireless via the wireless throttle assembly, some variants have wired connections to connect the throttle, brake, and on/off switch to the motor. Any wired or wireless protocol may be used.

Operation of the Vehicle

In operation, the user can place his or her feet generally on the front portion and rear portion of the deck 102. The user may rotate or tilt his or her body, shift his or her weight, and/or modify his or her foot positions to control the motion of the vehicle 100. For example, for steering, one side of the deck 102 can be tilted towards the ground to encourage a turn in that direction. In some configurations, the vehicle 100 can be operated as a flexible skateboard in that the user can cause, maintain, or increase locomotion of the vehicle 100 by causing the front and rear portions to be twisted or tilted relative to each other generally about a longitudinal axis of the deck 102.

In various embodiments, the rear wheel 134 can be used to accelerate or decelerate the vehicle. For example, the remote control can be used to send a signal to control (e.g., increase or decrease) an amount of power provided to the rear wheel by the motor and/or to initiate a braking action. The user can still control steering of the vehicle 100 by rotating his or her body, or by shifting his or her weight and/or foot position, on the deck 102 as discussed above.

In contrast to a conventional skateboard, movement of the vehicle 100 can be provided without the user needing to move his or her feet. For example, from a stopped position, the user can place his or her feet on the deck 102 and can actuate the trigger on the remote, thereby causing the motor to drive the rear wheel, which in turn propels the vehicle. In some embodiments, the user does not need to lift a foot off the deck and push off the ground in order to provide locomotion. In certain variants, the user does not need to move his or her feet (e.g., to cause the forward and rearward portions to move relative to one another) in order to provide locomotion.

In some embodiments, the auxiliary wheels 182 can be used to accelerate or decelerate the vehicle in addition to and/or instead of the rear wheel 134. For example, the remote control can be used to send a signal to control (e.g., increase or decrease) an amount of power provided to the auxiliary wheels 182 by the motor and/or to initiate a braking action. The user can still control steering of the vehicle 100 by rotating his or her body, or by shifting his or her weight and/or foot position, on the deck 102 as discussed above. In some embodiments, the auxiliary wheels 182 begin to spin when the wheels 182 touch the ground and the vehicle is already in motion. In some embodiments, the auxiliary wheels 182 can begin to rotate before the wheels 182 touch the ground. For example, in some embodiments, the auxiliary wheels 182 are powered, such as by the motor 152.

In some embodiments, by shifting his or her weight and/or foot position, the user can tilt the vehicle 100 side-to-side and/or front-to-back. When the user tilts the vehicle, the vehicle 100 can be alternatively supported by one auxiliary wheel 182 or the other auxiliary wheel. For example, the auxiliary wheel 182 positioned beneath the side of the vehicle on which the user leans can contact the ground. In some such configurations, the opposite auxiliary wheel 182 can be lifted off the ground. In some embodiments, both of the auxiliary wheels 182 remain in contact with the ground as the user tilts the vehicle. In some embodiments, as the user tilts the vehicle, the auxiliary wheels 182 help to prevent or inhibit the user from falling off the vehicle in a forward and/or backwards direction. Thus, the auxiliary wheels 182 can help to stabilize the vehicle 100 when in use.

Certain Terminology

Certain terminology may be used in the description herein for the purpose of reference only, and thus is not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import. Throughout the following description, like numbers refer to like components.

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Summary

Although this invention has been disclosed in the context of certain embodiments and examples, it will be understood by those skilled in the art that the present disclosure extends beyond the specifically disclosed embodiments to other alternative embodiments and/or uses of the invention and obvious modifications and equivalents thereof. In particular, while the present systems and methods have been described in the context of particular embodiments, the skilled artisan will appreciate, in view of the present disclosure, that certain advantages, features and aspects of the systems and methods may be realized in a variety of other applications, many of which have been noted above. Various features and aspects of the disclosed embodiments can be combined with or substituted for one another in order to form varying modes of the vehicle. The scope of this disclosure should not be limited by the particular disclosed embodiments described herein.

Additionally, it is contemplated that various aspects and features of the invention described can be practiced separately, combined together, or substituted for one another, and that a variety of combination and subcombinations of the features and aspects can be made and still fall within the scope of the invention. Certain features that are described in this disclosure in the context of separate implementations can also be implemented in combination in a single implementation. Conversely, various features that are described in the context of a single implementation can also be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination.

The separation of various system components in the implementations described above should not be understood as requiring such separation in all implementations. The described components and systems can generally be integrated together in a single product or packaged into multiple products. Additionally, other implementations are within the scope of this disclosure.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of personal mobility devices, such as scooters, have been disclosed. Although the devices have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular embodiments described above, but should be determined only by a fair reading of the claims that follow.

The following is claimed:

1. A powered board vehicle, comprising:

a deck configured to support a user, the deck having a support surface including:

a forward portion;

a rearward portion having a rear end; and a neck portion configured to connect the forward portion with the rearward portion;

a rear housing portion coupled with the rearward portion;

a rear wheel assembly supported by the rear housing portion, the rear wheel assembly including at least one rear wheel;

at least one front wheel connected with the forward portion and configured to roll over a surface, the front wheel configured to swivel about a first axis and rotate about a second axis; and an auxiliary wheel assembly, including:

at least two auxiliary wheel mounts, wherein the at least two auxiliary wheel mounts are mounted to the rear housing portion adjacent opposing lateral sides of the rearward portion; and an auxiliary wheel, wherein the auxiliary wheel extends rearwardly of the rear wheel assembly and rearwardly of the rear end of the rearward portion of the support surface.

2. The powered board vehicle of claim 1, wherein the auxiliary wheel is spaced away from the rear wheel assembly, wherein the auxiliary wheel is positioned adjacent a side of the deck, wherein the auxiliary wheel has an axis of rotation, and wherein the auxiliary wheel mount inhibits rotation of the auxiliary wheel about an axis that is transverse to the axis of rotation of the auxiliary wheel.

3. The powered board vehicle of claim 1, wherein the auxiliary wheel has an axis of rotation and wherein the axis of rotation is positioned rearward of a front portion of the auxiliary wheel mount.

4. The powered board vehicle of claim 1, wherein the auxiliary wheel assembly includes at least two auxiliary wheels.

5. The powered board vehicle of claim 1, wherein the auxiliary wheel does not contact the surface when the deck is in a neutral position, wherein the deck is in the neutral position when the deck is positioned approximately parallel to the surface.

6. The powered board vehicle of claim 1, wherein the auxiliary wheel has a diameter that is smaller than a diameter of the rear wheel.

7. The powered board vehicle of claim 1, wherein the front wheel is approximately aligned with the rear wheel in a neutral position.

8. The powered board vehicle of claim 1, wherein the deck is configured to flex about the neck portion.

9. The powered board vehicle of claim 1, further comprising a motor configured to power the rear wheel assembly.

10. The powered board vehicle of claim 9, wherein the rear wheel assembly includes a rear drive assembly configured to transmit power from the motor to the rear wheel of the rear wheel assembly.

11. The powered board vehicle of claim 1, further comprising a wired or wireless remote control that controls the powered rear wheel.

12. The powered board vehicle of claim 1, wherein the front wheel extends rearward at an angle when the front wheel is in a neutral position.

13. The powered board vehicle of claim 1, wherein the at least two auxiliary wheel mounts are mounted to the rear housing portion adjacent opposing lateralmost sides of the rearward portion.

14. A powered board vehicle, comprising:

a deck configured to support a user, the deck having a support surface including:

a forward portion;

a rearward portion having a rearmost portion;

a rear housing portion attached to the rearward portion; and a neck portion configured to connect the forward portion with the rearward portion, the neck portion configured to twist along a longitudinal axis of the vehicle; and a rear wheel assembly comprising a rear wheel, a rear drive assembly, an auxiliary wheel rearward of the rear wheel, and at least two auxiliary wheel mounts, wherein the auxiliary wheel projects rearward of the rearmost portion of the rearward portion of the support surface and the at least two auxiliary wheel mounts are mounted to the rear housing portion adjacent opposing lateral sides of the rearward portion.

15. The powered board vehicle of claim 14, further comprising a rear housing portion coupled with the rearward portion, wherein the rear housing portion is configured to support the rear wheel assembly.

16. The powered board vehicle of claim 15, wherein the rear housing portion includes a slot, and wherein the rear wheel assembly passes through the slot and is supported by the rear housing portion.

17. The powered board vehicle of claim 16, wherein the rear wheel assembly further comprises a rear wheel mount configured to support the rear wheel.

18. The powered board vehicle of claim 17, wherein the rear wheel mount includes a first side and a second side.

19. The powered board vehicle of claim 18, wherein the first side of the rear wheel mount is U-shaped.

20. The powered board vehicle of claim 18, wherein the first side of the rear wheel mount includes:

a first portion that extends downwardly relative to the deck;

a second portion that extends horizontally from the first portion; and a third portion spaced from the first portion by the second portion, wherein the third portion extends upwardly relative to the second portion.

21. The powered board vehicle of claim 18, wherein the second side is removably coupled to the first side such that the second side can translate in the slot away from the first side to allow the rear wheel to be removed.

* * * * *